US011391104B2

(12) United States Patent
Al-Abdulrahman et al.

(10) Patent No.: US 11,391,104 B2
(45) Date of Patent: Jul. 19, 2022

(54) FREEING A STUCK PIPE FROM A WELLBORE

(71) Applicant: Saudi Arabian Oil Company, Dhahran (SA)

(72) Inventors: Najeeb Al-Abdulrahman, Dhahran (SA); Bandar S. Al-Malki, Dammam (SA); Magbel Alharbi, Dammam (SA); Zainab Alsaihati, Saihat (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/891,352

(22) Filed: Jun. 3, 2020

(65) Prior Publication Data

US 2021/0381330 A1 Dec. 9, 2021

(51) Int. Cl.

| | |
|---|---|
| ***E21B 31/00*** | (2006.01) |
| ***E21B 29/10*** | (2006.01) |
| ***E21B 17/10*** | (2006.01) |
| ***E21B 29/00*** | (2006.01) |
| ***E21B 47/09*** | (2012.01) |
| ***E21B 31/16*** | (2006.01) |

(52) U.S. Cl.

CPC ..... *E21B 29/10* (2013.01); *E21B 17/1014* (2013.01); *E21B 29/002* (2013.01); *E21B 31/00* (2013.01); *E21B 31/16* (2013.01); *E21B 47/09* (2013.01)

(58) Field of Classification Search

CPC ..... E21B 29/10; E21B 29/002; E21B 47/09; E21B 17/1014; E21B 31/107; E21B 31/00; E21B 31/16

See application file for complete search history.

(56) References Cited

U.S. PATENT DOCUMENTS

| | | | |
|---|---|---|---|
| 891,957 | A | 6/1908 | Schubert |
| 2,286,673 | A | 6/1942 | Douglas |

(Continued)

FOREIGN PATENT DOCUMENTS

| | | |
|---|---|---|
| CA | 2669721 | 7/2011 |
| CN | 204627586 | 9/2015 |

(Continued)

OTHER PUBLICATIONS

"IADC Dull Grading for PDC Drill Bits," Beste Bit, SPE/IADC 23939, 1992, 52 pages.

(Continued)

*Primary Examiner* — Christopher J Sebesta
(74) *Attorney, Agent, or Firm* — Fish & Richardson P.C.

(57) ABSTRACT

A method of freeing a stuck pipe in a wellbore includes positioning a pipe freeing tool within an annulus of the stuck pipe, the pipe freeing tool including a body and two or more arms coupled to and extending from the body, and activating the two or more arms of the pipe freeing tool to extend outwards from the body to apply a force to the stuck pipe. Another method of freeing a stuck pipe in a wellbore includes determining a stuck point along a drillstring comprising the stuck pipe, and activating a pipe freeing tool coupled to the stuck pipe to apply a force to the stuck pipe, wherein the force moves the stuck pipe away from a surface of the wellbore and towards a center of the wellbore, and the pipe freeing tool includes a plurality of expandable disc elements.

8 Claims, 18 Drawing Sheets

(56) References Cited

U.S. PATENT DOCUMENTS 2,305,062 A 12/1942 Church et al.
2,344,120 A 3/1944 Baker
2,757,738 A 9/1948 Ritchey
2,509,608 A 5/1950 Penfield
2,688,369 A 9/1954 Broyles
2,719,363 A 10/1955 Richard et al.
2,795,279 A 6/1957 Erich
2,799,641 A 7/1957 Gordon
2,805,045 A 9/1957 Goodwin
2,841,226 A 7/1958 Conrad et al.
2,927,775 A 3/1960 Hildebrandt
3,016,244 A 1/1962 Friedrich et al.
3,028,915 A 4/1962 Jennings
3,087,552 A 4/1963 Graham
3,102,599 A 9/1963 Hillbum
3,103,975 A 9/1963 Hanson
3,104,711 A 9/1963 Haagensen
3,114,875 A 12/1963 Haagensen
3,133,592 A 5/1964 Tomberlin
3,137,347 A 6/1964 Parker
3,149,672 A 9/1964 Joseph et al.
3,169,577 A 2/1965 Erich
3,170,519 A 2/1965 Haagensen
3,211,220 A 10/1965 Erich
3,236,307 A 2/1966 Brown
3,268,003 A 8/1966 Essary
3,428,125 A 2/1969 Parker
3,522,848 A 8/1970 New
3,547,192 A 12/1970 Claridge et al.
3,547,193 A 12/1970 Gill
3,642,066 A 2/1972 Gill
3,656,564 A 4/1972 Brown
3,696,866 A 10/1972 Dryden
3,862,662 A 1/1975 Kern
3,874,450 A 4/1975 Kern
3,931,856 A 1/1976 Barnes
3,946,809 A 3/1976 Hagedorn
3,948,319 A 4/1976 Pritchett
4,008,762 A 2/1977 Fisher et al.
4,010,799 A 3/1977 Kern et al.
4,064,211 A 12/1977 Wood
4,084,637 A 4/1978 Todd
4,135,579 A 1/1979 Rowland et al.
4,140,179 A 2/1979 Kasevich et al.
4,140,180 A 2/1979 Bridges et al.
4,144,935 A 3/1979 Bridges et al.
4,191,493 A 3/1980 Hansson et al.
4,193,448 A 3/1980 Jeambey
4,193,451 A 3/1980 Dauphine
4,196,329 A 4/1980 Rowland et al.
4,199,025 A 4/1980 Carpenter
4,265,307 A 5/1981 Elkins
RE30,738 E 9/1981 Bridges et al.
4,301,865 A 11/1981 Kasevich et al.
4,320,801 A 3/1982 Rowland et al.
4,334,928 A 6/1982 Hara
4,343,651 A 8/1982 Yazu et al.
4,353,585 A 10/1982 Carver
4,354,559 A 10/1982 Johnson
4,373,581 A 2/1983 Toellner
4,394,170 A 7/1983 Sawaoka et al.
4,396,062 A 8/1983 Iskander
4,412,585 A 11/1983 Bouck
4,449,585 A 5/1984 Bridges et al.
4,457,365 A 7/1984 Kasevich et al.
4,470,459 A 9/1984 Copland
4,476,926 A 10/1984 Bridges et al.
4,484,627 A 11/1984 Perkins
4,485,868 A 12/1984 Sresty et al.
4,485,869 A 12/1984 Sresty et al.
4,487,257 A 12/1984 Dauphine
4,495,990 A 1/1985 Titus et al.
4,498,535 A 2/1985 Bridges
4,499,948 A 2/1985 Perkins
4,508,168 A 4/1985 Heeren
4,513,815 A 4/1985 Rundell et al.
4,524,826 A 6/1985 Savage
4,524,827 A 6/1985 Bridges et al.
4,545,435 A 10/1985 Bridges et al.
4,553,592 A 11/1985 Looney et al.
4,557,327 A 12/1985 Kinley et al.
4,576,231 A 3/1986 Dowling et al.
4,583,589 A 4/1986 Kasevich
4,592,423 A 6/1986 Savage et al.
4,612,988 A 9/1986 Segalman
4,620,593 A 11/1986 Haagensen
4,660,636 A 4/1987 Rundell et al.
4,705,108 A 11/1987 Little et al.
4,817,711 A 4/1989 Jeambey
4,960,173 A * 10/1990 Cognevich ..... E21B 17/06 166/178
5,037,704 A 8/1991 Nakai et al.
5,055,180 A 10/1991 Klaila
5,068,819 A 11/1991 Misra et al.
5,082,054 A 1/1992 Kiamanesh
5,092,056 A 3/1992 Deaton
5,107,705 A 4/1992 Wraight et al.
5,107,931 A 4/1992 Valka et al.
5,228,518 A 7/1993 Wilson et al.
5,236,039 A 8/1993 Edelstein et al.
5,278,550 A 1/1994 Rhein-Knudsen et al.
5,388,648 A 2/1995 Jordan, Jr.
5,490,598 A 2/1996 Adams
5,501,248 A 3/1996 Kiest, Jr.
5,690,826 A 11/1997 Cravello
5,803,666 A 9/1998 Keller
5,813,480 A 9/1998 Zaleski, Jr. et al.
5,853,049 A 12/1998 Keller
5,890,540 A 4/1999 Pia et al.
5,899,274 A 5/1999 Frauenfeld et al.
5,947,213 A 9/1999 Angle
5,958,236 A 9/1999 Bakula
RE36,362 E 11/1999 Jackson
6,012,526 A 1/2000 Jennings et al.
6,041,860 A 3/2000 Nazzal et al.
6,096,436 A 8/2000 Inspektor
6,170,531 B1 1/2001 Jung et al.
6,173,795 B1 1/2001 McGarian et al.
6,189,611 B1 2/2001 Kasevich
6,254,844 B1 7/2001 Takeuchi et al.
6,268,726 B1 7/2001 Prammer
6,269,953 B1 8/2001 Seyffert et al.
6,290,068 B1 9/2001 Adams et al.
6,325,216 B1 12/2001 Seyffert et al.
6,328,111 B1 12/2001 Bearden et al.
6,354,371 B1 3/2002 O'Blanc
6,371,302 B1 4/2002 Adams et al.
6,413,399 B1 7/2002 Kasevich
6,443,228 B1 9/2002 Aronstam
6,454,099 B1 9/2002 Adams et al.
6,510,947 B1 1/2003 Schulte et al.
6,534,980 B2 2/2003 Toufaily et al.
6,544,411 B2 4/2003 Varandaraj
6,561,269 B1 5/2003 Brown et al.
6,571,877 B1 6/2003 Van Bilderbeek
6,607,080 B2 8/2003 Winkler et al.
6,612,384 B1 9/2003 Singh et al.
6,623,850 B2 9/2003 Kukino et al.
6,629,610 B1 10/2003 Adams et al.
6,637,092 B1 10/2003 Menzel
6,678,616 B1 1/2004 Winkler et al.
6,722,504 B2 4/2004 Schulte et al.
6,761,230 B2 7/2004 Cross et al.
6,814,141 B2 11/2004 Huh et al.
6,845,818 B2 1/2005 Tutuncu et al.
6,850,068 B2 2/2005 Chernali et al.
6,895,678 B2 5/2005 Ash et al.
6,912,177 B2 6/2005 Smith
6,971,265 B1 12/2005 Sheppard et al.
6,993,432 B2 1/2006 Jenkins et al.
7,000,777 B2 2/2006 Adams et al.
7,013,992 B2 3/2006 Tessari et al.
7,048,051 B2 5/2006 McQueen
7,091,460 B2 8/2006 Kinzer

(56) References Cited

U.S. PATENT DOCUMENTS 7,109,457 B2 9/2006 Kinzer
7,115,847 B2 10/2006 Kinzer
7,216,767 B2 5/2007 Schulte et al.
7,312,428 B2 12/2007 Kinzer
7,322,776 B2 1/2008 Webb et al.
7,331,385 B2 2/2008 Symington
7,376,514 B2 5/2008 Habashy et al.
7,387,174 B2 6/2008 Lurie
7,445,041 B2 11/2008 O'Brien
7,455,117 B1 11/2008 Hall et al.
7,461,693 B2 12/2008 Considine et al.
7,484,561 B2 2/2009 Bridges
7,562,708 B2 7/2009 Cogliandro et al.
7,629,497 B2 12/2009 Pringle
7,631,691 B2 12/2009 Symington et al.
7,650,269 B2 1/2010 Rodney
7,677,673 B2 3/2010 Tranquilla et al.
7,730,625 B2 6/2010 Blake
7,951,482 B2 5/2011 Ichinose et al.
7,980,392 B2 7/2011 Varco
8,237,444 B2 8/2012 Simon
8,245,792 B2 8/2012 Trinh et al.
8,275,549 B2 9/2012 Sabag et al.
8,484,858 B2 7/2013 Brannigan et al.
8,511,404 B2 8/2013 Rasheed
8,526,171 B2 9/2013 Wu et al.
8,528,668 B2 9/2013 Rasheed
8,567,491 B2 10/2013 Lurie
8,794,062 B2 8/2014 DiFoggio et al.
8,851,193 B1 * 10/2014 Valerio ..... E21B 31/18 166/385
8,884,624 B2 11/2014 Homan et al.
8,925,213 B2 1/2015 Sallwasser
8,960,215 B2 2/2015 Cui et al.
9,217,323 B2 12/2015 Clark
9,222,350 B2 12/2015 Vaughn et al.
9,250,339 B2 2/2016 Ramirez
9,394,782 B2 7/2016 DiGiovanni et al.
9,435,159 B2 9/2016 Scott
9,464,487 B1 10/2016 Zurn
9,470,059 B2 10/2016 Zhou
9,482,062 B1 11/2016 Zhou
9,494,032 B2 11/2016 Roberson et al.
9,528,366 B2 12/2016 Selman et al.
9,562,987 B2 2/2017 Guner et al.
9,664,011 B2 5/2017 Kruspe et al.
9,702,211 B2 7/2017 Tinnen
9,731,471 B2 8/2017 Schaedler et al.
9,739,141 B2 8/2017 Zeng et al.
10,000,983 B2 6/2018 Jackson et al.
10,174,577 B2 1/2019 Leuchtenberg et al.
10,233,372 B2 3/2019 Ramasamy et al.
10,394,193 B2 8/2019 Li et al.
2003/0159776 A1 8/2003 Graham
2003/0230526 A1 12/2003 Okabayshi et al.
2004/0182574 A1 9/2004 Sarmad et al.
2004/0256103 A1 12/2004 Batarseh
2004/0262005 A1 12/2004 Harmon et al.
2005/0211429 A1 9/2005 Gray et al.
2005/0259512 A1 11/2005 Mandal
2006/0016592 A1 1/2006 Wu
2006/0106541 A1 5/2006 Hassan et al.
2006/0144620 A1 7/2006 Cooper
2006/0185843 A1 8/2006 Smith
2006/0249307 A1 11/2006 Ritter
2007/0131591 A1 6/2007 Pringle
2007/0137852 A1 6/2007 Considine et al.
2007/0187089 A1 8/2007 Bridges
2007/0204994 A1 9/2007 Wimmersperg
2007/0227736 A1 * 10/2007 Sheiretov ..... E21B 17/1021 166/301
2007/0289736 A1 12/2007 Kearl et al.
2008/0007421 A1 1/2008 Liu et al.
2008/0047337 A1 2/2008 Chemali et al.
2008/0169107 A1 * 7/2008 Redlinger ..... E21B 17/1014 166/382
2008/0173480 A1 7/2008 Annaiyappa et al.
2008/0190822 A1 8/2008 Young
2008/0308282 A1 12/2008 Standridge et al.
2009/0164125 A1 6/2009 Bordakov et al.
2009/0178809 A1 7/2009 Jeffryes et al.
2009/0259446 A1 10/2009 Zhang et al.
2010/0089583 A1 4/2010 Xu et al.
2010/0276209 A1 11/2010 Yong et al.
2010/0282511 A1 11/2010 Maranuk
2011/0011576 A1 1/2011 Cavender et al.
2011/0120732 A1 5/2011 Lurie
2012/0012319 A1 1/2012 Dennis
2012/0048542 A1 * 3/2012 Jacob ..... E21B 17/1021 166/254.2
2012/0111578 A1 5/2012 Tverlid
2012/0132418 A1 5/2012 McClung
2012/0173196 A1 7/2012 Miszewski
2012/0222854 A1 9/2012 McClung, III
2012/0273187 A1 11/2012 Hall
2013/0008653 A1 1/2013 Schultz et al.
2013/0008671 A1 1/2013 Booth
2013/0025943 A1 1/2013 Kumar
2013/0076525 A1 3/2013 Vu et al.
2013/0125642 A1 5/2013 Parfitt
2013/0126164 A1 5/2013 Sweatman et al.
2013/0213637 A1 8/2013 Kearl
2013/0255936 A1 10/2013 Statoilydro et al.
2014/0083771 A1 3/2014 Clark
2014/0183143 A1 7/2014 Cady et al.
2014/0231147 A1 8/2014 Bozso et al.
2014/0246235 A1 9/2014 Yao
2014/0251894 A1 9/2014 Larson et al.
2014/0278111 A1 9/2014 Gerrie et al.
2014/0291023 A1 10/2014 Edbmy
2014/0333754 A1 11/2014 Graves et al.
2014/0360778 A1 12/2014 Batarseh
2014/0375468 A1 12/2014 Wilkinson et al.
2015/0020908 A1 1/2015 Warren
2015/0021240 A1 1/2015 Wardell et al.
2015/0083422 A1 3/2015 Pritchard
2015/0091737 A1 4/2015 Richardson et al.
2015/0101864 A1 4/2015 May
2015/0159467 A1 6/2015 Hartman et al.
2015/0211362 A1 7/2015 Rogers
2015/0267500 A1 9/2015 Van Dongen
2015/0290878 A1 10/2015 Houben et al.
2016/0053572 A1 2/2016 Snoswell
2016/0076357 A1 3/2016 Hbaieb
2016/0115783 A1 4/2016 Zeng et al.
2016/0153240 A1 6/2016 Braga et al.
2016/0160106 A1 6/2016 Jamison et al.
2016/0237810 A1 8/2016 Beaman et al.
2016/0247316 A1 8/2016 Whalley et al.
2016/0356125 A1 12/2016 Bello et al.
2017/0161885 A1 6/2017 Parmeshwar et al.
2017/0234104 A1 8/2017 James
2017/0292376 A1 10/2017 Kumar et al.
2017/0314335 A1 11/2017 Kosonde et al.
2017/0328196 A1 11/2017 Shi et al.
2017/0328197 A1 11/2017 Shi et al.
2017/0342776 A1 11/2017 Bullock et al.
2017/0350201 A1 12/2017 Shi et al.
2017/0350241 A1 12/2017 Shi
2018/0010030 A1 1/2018 Ramasamy et al.
2018/0010419 A1 1/2018 Livescu et al.
2018/0171772 A1 6/2018 Rodney
2018/0187498 A1 7/2018 Soto et al.
2018/0265416 A1 9/2018 Ishida et al.
2018/0326679 A1 11/2018 Weisenberg et al.
2019/0049054 A1 2/2019 Gunnarsson et al.
2019/0101872 A1 4/2019 Li
2019/0227499 A1 7/2019 Li et al.
2019/0257180 A1 8/2019 Kriesels et al.
2019/0345787 A1 11/2019 Stephenson et al.
2020/0032638 A1 1/2020 Ezzeddine
2020/0165891 A1 5/2020 Al-Qasim et al.

(56) References Cited

U.S. PATENT DOCUMENTS

FOREIGN PATENT DOCUMENTS

| | | |
|---|---|---|
| CN | 107462222 | 12/2017 |
| CN | 110571475 | 12/2019 |
| EP | 2317068 | 5/2011 |
| EP | 2574722 | 4/2013 |
| EP | 2737173 | 6/2014 |
| GB | 2357305 | 6/2001 |
| GB | 2399515 | 9/2004 |
| GB | 2422125 | 7/2006 |
| GB | 2532967 | 6/2016 |
| JP | 2009067609 | 4/2009 |
| JP | 4275896 | 6/2009 |
| JP | 5013156 | 8/2012 |
| NO | 343139 | 11/2018 |
| NO | 20161842 | 5/2019 |
| RU | 2282708 | 8/2006 |
| WO | WO 2000025942 | 5/2000 |
| WO | WO 2001042622 | 6/2001 |
| WO | WO 2002068793 | 9/2002 |
| WO | WO 2008146017 | 12/2008 |
| WO | WO 2009020889 | 2/2009 |
| WO | WO 2009113895 | 9/2009 |
| WO | WO 2010105177 | 9/2010 |
| WO | WO 2011038170 | 3/2011 |
| WO | WO 2011042622 | 6/2011 |
| WO | WO 2013016095 | 1/2013 |
| WO | WO 2013148510 | 10/2013 |
| WO | WO 2015095155 | 6/2015 |
| WO | WO 2016178005 | 11/2016 |
| WO | WO 2017011078 | 1/2017 |
| WO | WO 2017132297 | 8/2017 |
| WO | WO 2018169991 | 9/2018 |
| WO | WO 2019040091 | 2/2019 |
| WO | WO 2019055240 | 3/2019 |
| WO | WO 2019089926 | 5/2019 |
| WO | WO 2019108931 | 6/2019 |
| WO | WO 2019169067 | 9/2019 |
| WO | WO 2019236288 | 12/2019 |
| WO | WO 2019246263 | 12/2019 |

OTHER PUBLICATIONS

Akersolutions, Aker MH CCTC Improving Safety, Jan. 2008.

Anwar et al.,"Fog computing: an overview of big IoT data analytics," Wireless communications and mobile computing, May 2018, 2018: 1-22.

Artymiuk et al., "The new drilling control and monitoring system," Acta Montanistica Slovaca, Sep. 2004, 9(3): 145-151.

Ashby et al., "Coiled Tubing Conveyed Video Camera and Multi-Arm Caliper Liner Damage Diagnostics Post Plug and Perf Frac," Society of Petroleum Engineers, SPE-172622-MS, Mar. 2015, p. 12.

Bilal et al., "Potentials, trends, and prospects in edge technologies: Fog, cloudlet, mobile edge, and micro data centers," Computer Networks, Elsevier, Oct. 2017, 130: 94-120.

Carpenter, "Advancing Deepwater Kick Detection", JPT, vol. 68, Issue 5, May 2016, 2 pages.

Commer et al., "New advances in three-dimensional controlled-source electromagnetic inversion," Geophys. J. Int., 2008, 172: 513-535.

Dickens et al., "An LED array-based light induced fluorescence sensor for real-time process and field monitoring," Sensors and Actuators B: Chemical, Elsevier, Apr. 2011, 158(1): 35-42.

Dong et al., "Dual Substitution and Spark Plasma Sintering to Improve Ionic Conductivity of Garnet Li7La3Zr2O12," Nanomaterials, 9, 721, 2019, 10 pages.

downholediagnostic.com [online] "Acoustic Fluid Level Surveys," retrieved from URL <https://www.downholediagnostic.com/fluid-level> retrieved on Mar. 27, 2020, available on or before 2018, 13 pages.

edition.cnn.com [online], "Revolutionary gel is five times stronger than steel," retrieved from URL <https://edition.cnn.com/style/article/hydrogel-steel-japan/index.html>, retrieved on Apr. 2, 2020, available on or before Jul. 16, 2017, 6 pages.

Gemmeke and Ruiter, "3D ultrasound computer tomography for medical imagining," Nuclear Instruments and Methods in Physics Research A 580, Oct. 1, 2007, 9 pages.

Halliburton, "Drill Bits and Services Solutions Catalogs," retrieved from URL: <https://www.halliburton.com/content/dam/ps/public/sdbs/sdbs_contents/Books_and_Catalogs/web/DBS-Solution.pdf> on Sep. 26, 2019, Copyright 2014, 64 pages.

Ji et al., "Submicron Sized Nb Doped Lithium Garnet for High Ionic Conductivity Solid Electrolyte and Performance of All Solid-State Lithium Battery," doi:10.20944/preprints201912.0307.v1, Dec. 2019, 10 pages.

Johnson et al., "Advanced Deepwater Kick Detection," IADC/SPE 167990, presented at the 2014 IADC/SPE Drilling Conference and Exhibition, Mar. 4-6, 2014, 10 pages.

Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.

King et al., "Atomic layer deposition of TiO2 films on particles in a fluidized bed reactor," Power Technology, vol. 183, Issue 3, Apr. 2008, 8 pages.

Li et al., 3D Printed Hybrid Electrodes for Lithium-ion Batteries, Missouri University of Science and Technology, Washington State University; ECS Transactions, 77 (11) 1209-1218 (2017), 11 pages.

Liu et al., "Flow visualization and measurement in flow field of a torque converter," Mechanic automation and control Engineering, Second International Conference on IEEE, Jul. 15, 2011, 1329-1331.

Liu et al., "Superstrong micro-grained poly crystalline diamond compact through work hardening under high pressure," Appl. Phys. Lett. Feb. 2018, 112: 6 pages.

nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Jan. 19, 2018, 47 pages.

Nuth, "Smart oil field distributed computing," The Industrial Ethernet Book, Nov. 2014, 85(14): 1-3.

Olver, "Compact Antenna Test Ranges," Seventh International Conference on Antennas and Propagation IEEE , Apr. 15-18, 1991, 10 pages.

Parini et al., "Chapter 3: Antenna measurements," in Theory and Practice of Modern Antenna Range Measurements, IET editorial, 2014, 30 pages.

petrowiki.org [online], "Kicks," Petrowiki, available on or before Jun. 26, 2015, retrieved on Jan. 24, 2018, retrieved from URL <https://petrowiki.org/Kicks>, 6 pages.

rigzone.com [online], "How does Well Control Work?" Rigzone, available on or before 1999, retrieved on Jan. 24, 2019, retrieved from URL <https://www.rigzone.com/training/insight.asp?insight_id=304&c_id>, 5 pages.

Ruiter et al., "3D ultrasound computer tomography of the breast: A new era?" European Journal of Radiology 81S1, Sep. 2012, 2 pages.

sageoiltools.com [online] "Fluid Level & Dynamometer Instments for Analysis due Optimization of Oil and Gas Wells," retrieved from URL <http://www.sageoiltools.com/>, retrieved on Mar. 27, 2020, available on or before 2019, 3 pages.

Schlumberger, "First Rigless ESP Retrieval and Replacement with Slickline, Offshore Congo: Zeitecs Shuttle System Eliminates Need to Mobilize a Workover Rig," slb.com/zeitecs, 2016, 1 page.

Schlumberger, "The Lifting Business," Offshore Engineer, Mar. 2017, 1 page.

Schlumberger, "Zeitecs Shuttle System Decreases ESP Replacement Time by 87%: Customer ESP riglessly retrieved in less than 2 days on coiled tubing," slb.com/zeitecs, 2015, 1 page.

Schlumberger, "Zeitecs Shuttle System Reduces Deferred Production Even Before ESP is Commissioned, Offshore Africa: Third Party ESP developed fault during installation and was retrieved on rods, enabling operator to continue running tubing without waiting on replacement," slb.com/zeitecs, 2016, 2 pages.

(56) References Cited

OTHER PUBLICATIONS

Schlumberger, "Zeitecs Shuttle: Rigless ESP replacement system," Brochure, 8 pages.
Schlumberger, "Zeitecs Shuttle: Rigless ESP replacement system," Schlumberger, 2017, 2 pages.
slb.com [online] "Technical Paper: ESP Retrievable Technology: A Solution to Enhance ESP Production While Minimizing Costs," SPE 156189 presented in 2012, retrieved from URL <http://www.slb.com/resources/technical_papers/artificial_lift/156189.aspx>, retrieved on Nov. 2, 2018, 1 pages.
slb.com [online], "Zeitecs Shuttle Rigless ESP Replacement System," retrieved from URL <http://www.slb.com/services/production/artificial_lift/submersible/zeitecs-shuttle.aspx?t=3>, available on or before May 31, 2017, retrieved on Nov. 2, 2018, 3 pages.
Sulzer Metco, "An Introduction to Thermal Spray," Issue 4, 2013, 24 pages.
Wei et al., "The Fabrication of All-Solid-State Lithium-Ion Batteries via Spark Plasma Sintering," Metals, 7, 372, 2017, 9 pages.
wikipedia.org [online] "Optical Flowmeters," retrieved from URL <https://en.wikipedia.org/wiki/Flow_measurement#Optical_flowmeters>, retrieved on Mar. 27, 2020, available on or before Jan. 2020, 1 page.
wikipedia.org [online] "Ultrasonic Flow Meter," retrieved from URL <https://en.wikipedia.org/wiki/Ultrasonic_flow_meter> retrieved on Mar. 27, 2020, available on or before Sep. 2019, 3 pages.
wikipedia.org [online], "Surface roughness," retrieved from URL <https://en.wikipedia.org/wiki/Surface_roughness> retrieved on Apr. 2, 2020, available on or before Oct. 2017, 6 pages.
Xue et al., "Spark plasma sintering plus heat-treatment of Ta-doped Li7La3Zr2O12 solid electrolyte and its ionic conductivity," Mater. Res. Express 7 (2020) 025518, 8 pages.
Zhan et al. "Effect of β-to-α Phase Transformation on the Microstructural Development and Mechanical Properties of Fine-Grained Silicon Carbide Ceramics." Journal of the American Ceramic Society 84.5, May 2001, 6 pages.
Zhan et al. "Single-wall carbon nanotubes as attractive toughening agents in alumina-based nanocomposites." Nature Materials 2,1, Jan. 2003, 6 pages.
Zhan et al., "Atomic Layer Deposition on Bulk Quantities of Surfactant Modified Single-Walled Carbon Nanotubes," Journal of American Ceramic Society, vol. 91, Issue 3, Mar. 2008, 5 pages.
Zhang et al., "Increasing Polypropylene High Temperature Stability by Blending Polypropylene-Bonded Hindered Phenol Antioxidant," Macromolecules, 51(5), pp. 1927-1936, 2018, 10 pages.
Zhu et al., "Spark Plasma Sintering of Lithium Aluminum Germanium Phosphate Solid Electrolyte and its Electrochemical Properties," University of British Columbia; Nanomaterials, 9, 1086, 2019, 10 pages.
PCT International Search Report and Written Opinion in International Appln. No. PCT/US2021/035441, dated Aug. 20, 2021, 14 pages.

* cited by examiner

FREEING A STUCK PIPE FROM A WELLBORE

TECHNICAL FIELD

This disclosure relates to apparatus, systems, and method for freeing a stuck pipe from a wellbore, and, more particularly, to downhole tools for freeing a stuck pipe from a wellbore.

BACKGROUND

During drilling operations, a pipe can become stuck against the side of the wellbore, which restricts the movement of the pipe while drilling the wellbore. In order to continue drilling operations, the pipe must be freed from the wellbore. In addition, pipe can be stuck during production operations, causing the production operations in the wellbore to be delayed or terminated. Freeing a stuck pipe can be time sensitive, as the likelihood of freeing a stuck pipe decreases with the passage of time. In addition, if the stuck pipe is not freed from the side of the wellbore, a sidetracking operation often must be performed in order to continue drilling or production operations. Current methods of freeing a stuck pipe are time-consuming, resulting in significant amounts of non-productive time in drilling and production operations.

SUMMARY

In an example implementation, a method of freeing a stuck pipe in a wellbore includes positioning a pipe freeing tool within an annulus of the stuck pipe, the pipe freeing tool including a body and two or more arms coupled to and extending from the body, and activating the two or more arms of the pipe freeing tool to extend outwards from the body to apply a force to the stuck pipe, wherein the force moves the stuck pipe away from a surface of the wellbore and towards a center of the wellbore.

This, and other implementations, can include one or more of the following features. Activating the two or more arms of the pipe freeing tool can cause the two or more arms to perforate and extend through a wall of the stuck pipe. The pipe freeing tool can include a plurality of cutting surfaces, wherein each cutting surface of the plurality of cutting surfaces is disposed on an end of a respective arm of the two or more arms and is configured to pierce the wall of the stuck pipe as the two or more arms are extended outwards from the body. An outer diameter of the body can be smaller than an inner diameter of the stuck pipe. Positioning the pipe freeing tool within the annulus of the stuck pipe can include coupling the pipe freeing tool to a downhole conveyance, and lowering the pipe freeing tool through an annulus of the stuck pipe using the downhole conveyance. The downhole conveyance can include at least one of a pipe, a wireline, a working string, or coiled tubing. Activating the two or more arms of the pipe freeing tool can include activating the two or more arms using a power cable coupled to the pipe freeing tool. Activating the two or more arms can cause the two or arms to extend outwards from the body until each of the two or more arms contacts the surface of the wellbore. Activating the two or more arms can cause the two or arms to extend outwards from the body until each of the two or more arms extends to a predetermined extended length. The predetermined extended length can correspond to a size of the wellbore.

In some implementations, a method of freeing a stuck pipe in a wellbore includes determining a stuck point along a drillstring comprising the stuck pipe, and activating a pipe freeing tool coupled to the stuck pipe to apply a force to the stuck pipe, wherein the force moves the stuck pipe away from a surface of the wellbore and towards a center of the wellbore, and the pipe freeing tool includes a plurality of expandable disc elements.

This, and other implementations, can include one or more of the following features. Activating the pipe freeing tool can include causing at least one expandable disc element of the plurality of expandable disc elements to expand radially outward and encircle the stuck pipe. Expanding the at least one expandable disc element can cause the at least one expandable disc element to contact a surface of the wellbore. The method includes deactivating the pipe freeing tool after freeing the stuck pipe, wherein deactivating the pipe freeing tool causes the at least one expandable disc element to retract into an unexpanded position. Deactivating the pipe freeing tool can include increasing a pressure within the wellbore above a threshold pressure. Each expandable disc element of the plurality of expandable disc elements can include a seat within an annulus of the respective expandable disc element, and activating the pipe freeing tool can include seating a ball within the seat of an expandable disc element of the plurality of disc elements, wherein the ball is sized to correspond to a width of the respective seat. A first seat of a first expandable disc element of the plurality of disc elements can have a first width, and a second seat of a second expandable disc element of the plurality of disc elements can have a second width that is smaller than the first width, wherein the second expandable disc element is positioned downhole of the first expandable disc element. Activating the pipe freeing tool can include causing an expandable disc element of the plurality of expandable disc elements positioned along the drillstring closest to the stuck point to expand outward and encircle the stuck pipe. Each expandable disc element of the plurality of expandable disc elements can include an expandable metal. Determining the stuck point along the drillstring can include monitoring a weight indicator coupled to the drillstring.

Example embodiments of the present disclosure may include one, some, or all of the following features. For example, a pipe freeing tool according to the present disclosure may reduce downtime during drilling operations or production operations by reducing the time required to free a stuck pipe from against a surface of a wellbore. Further, a pipe freeing tool according to the present disclosure may free a stuck pipe without causing damage to the stuck pipe. In addition, a pipe freeing tool according to the present disclosure may allow for drilling operations or production operations within a wellbore to continue shortly after using the pipe freeing tool according to the present disclosure to free a stuck pipe from the surface of the wellbore.

The details of one or more embodiments of the disclosure are set forth in the accompanying drawings and the description below. Other features, objects, and advantages of the disclosure will be apparent from the description and drawings, and from the claims.

DETAILED DESCRIPTION

The present disclosure describes tools and systems for freeing a stuck pipe from a wellbore.

Figure 1:
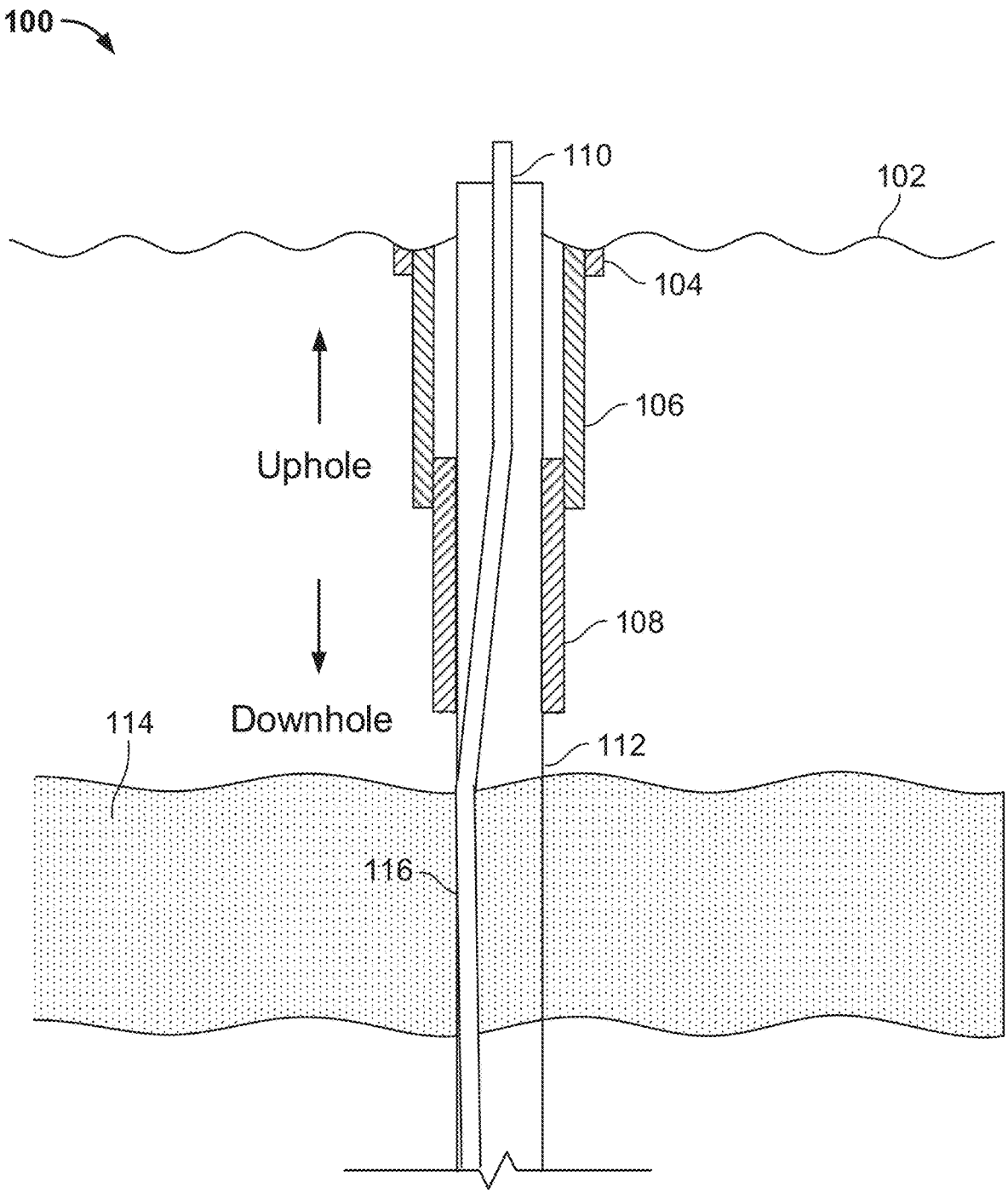
FIG. 1 is a schematic illustration of a wellbore system with a stuck pipe.

FIG. 1 is a schematic illustration of an example wellbore system 100 including a drillstring 110. The drillstring 110 is operable to apply torque to a drill bit to form a wellbore 112, as well as convey formation fluid in the wellbore 112 to the terranean surface 102.

Although not shown, a drilling assembly deployed on the terranean surface 102 may be used in conjunction with the drillstring 110 to form the wellbore 112 through a particular location in the subterranean zone 114. The wellbore 112 may be formed to extend from the terranean surface 102 through one or more geological formations in the Earth. One or more subterranean formations, such as subterranean zone 114, are located under the terranean surface 102. One or more wellbore casings, such as surface casing 106 and intermediate casing 108, may be installed in at least a portion of the wellbore 112.

Although shown as a wellbore 112 that extends from land, the wellbore 112 may be formed under a body of water rather than the terranean surface 102. For instance, in some embodiments, the terranean surface 102 may be a surface under an ocean, gulf, sea, or any other body of water under which hydrocarbon-bearing, or water-bearing, formations may be found. In short, reference to the terranean surface 102 includes both land and underwater surfaces and contemplates forming or developing (or both) one or more wellbores 112 from either or both locations.

Generally, the wellbore 112 may be formed by any appropriate assembly or drilling rig used to form wellbores or boreholes in the Earth. A drilling assembly may use traditional techniques to form such wellbores or may use nontraditional or novel techniques. Although shown as a substantially vertical wellbore (for example, accounting for drilling imperfections), the wellbore 112, in alternative aspects, may be directional, horizontal, curved, multi-lateral, or other forms other than merely vertical.

One or more tubular casings may be installed in the wellbore 112 during portions of forming the wellbore 112. As illustrated, the wellbore 112 includes a conductor casing 104, which extends from the terranean surface 102 shortly into the Earth. A portion of the wellbore portion 112 enclosed by the conductor casing 104 may be a large diameter borehole.

Downhole of the conductor casing 104 may be the surface casing 106. The surface casing 106 may enclose a slightly smaller borehole and protect the wellbore 112 from intrusion of, for example, freshwater aquifers located near the terranean surface 102. The wellbore 112 may then extend vertically downward. This portion of the wellbore 112 may be enclosed by the intermediate casing 108. In some aspects, the wellbore 112 can include an open hole portion (for example, with no casing present).

The drillstring 110 may be made up of multiple sections of drill pipe 116. As can be seen in FIG. 1, the drillstring 110 includes a section of drill pipe 116 that is stuck against a surface of the wellbore 112.

Figure 2:
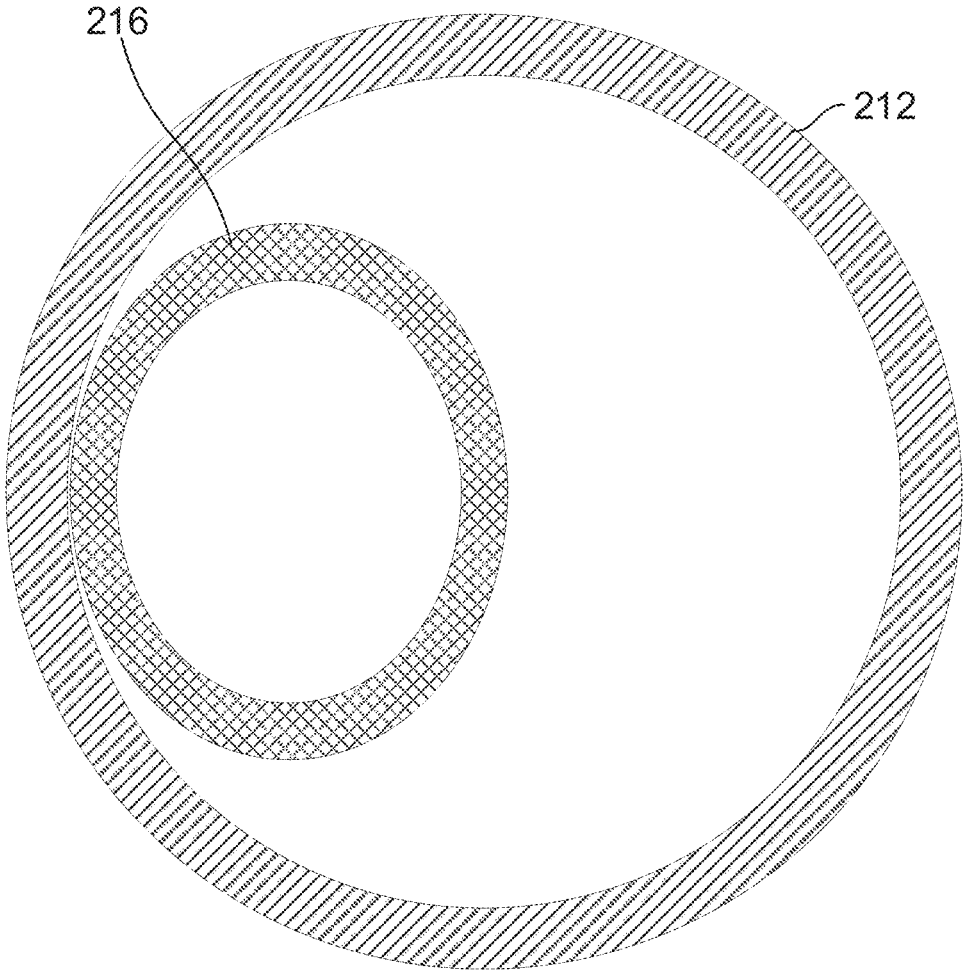
FIG. 2 is a schematic top view of a wellbore system with a stuck pipe.

FIG. 2 depicts a top view of a wellbore 212 with a section of drill pipe 216 stuck in the wellbore 212. As can be seen in FIG. 2, in some implementations, a section of drill pipe 216 can become lodged against a surface of the wellbore 212 during drilling operations, which prevents vertical and/or rotational movement of the drill pipe 216 within the wellbore 212, thus causing the drill pipe 216 to become "stuck" within the wellbore 212. In order to continue drilling operations within the wellbore 212, the stuck drill pipe 216 must be freed from the surface of the wellbore 212 to allow for movement of the drill pipe 216.

Figure 3A:
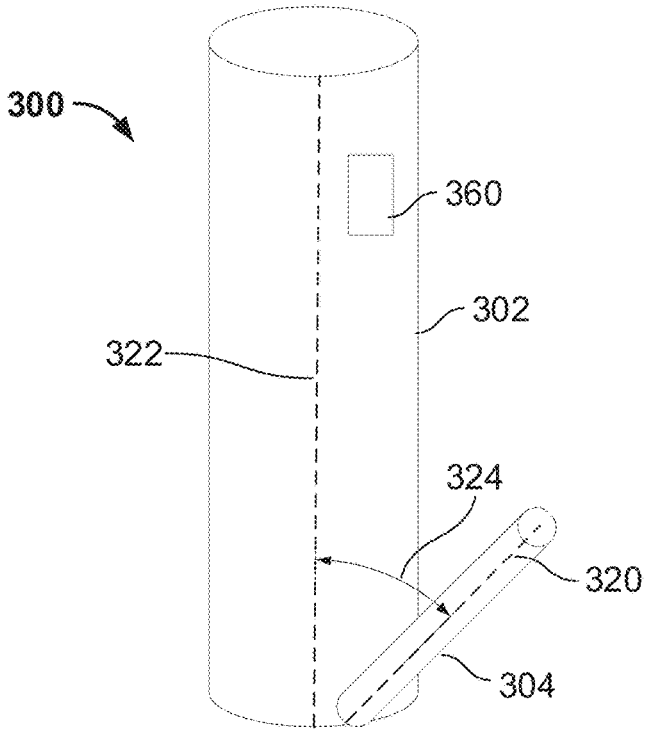
FIG. 3A-3C are schematic illustrations on an example tool for freeing a stuck pipe in a wellbore.
Figure 3B:
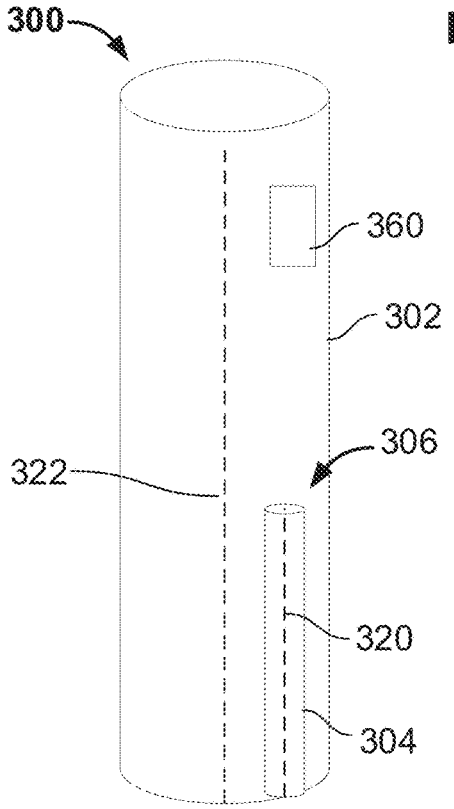
Figure 3C:
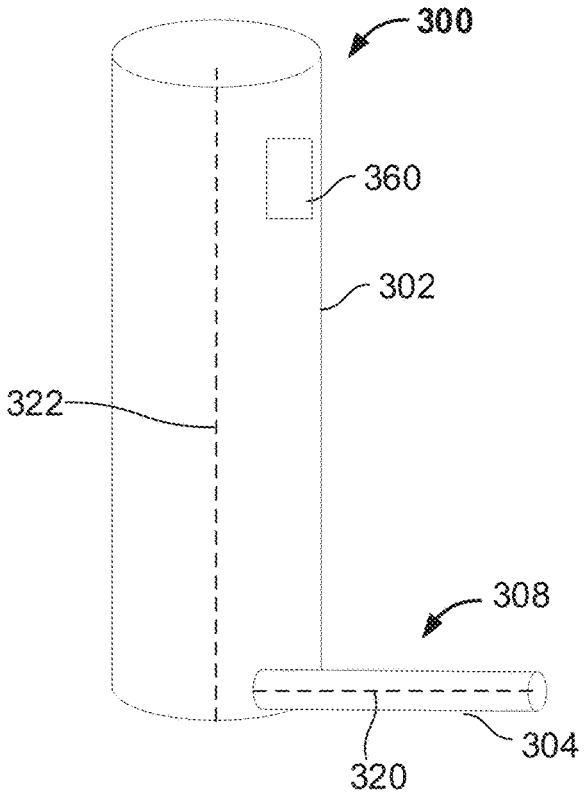

FIGS. 3A-3C are schematic illustrations of an example implementation of a tool 300 for freeing a stuck section of drill pipe in a wellbore. For example, in some aspects, the pipe freeing tool 300 may be used in the wellbore system 100 to free a stuck portion of the drill pipe 116 from the surface of the wellbore 112.

As can be seen in FIG. 3A, the illustrated implementation of the pipe freeing tool 300 includes a downhole conveyance 302 and a side arm 304 coupled to the downhole conveyance 302 near an end of the downhole conveyance 302. In some implementations, as depicted in FIGS. 3A-3C, the downhole conveyance 302 is a tubular pipe. In some implementations, the downhole conveyance 302 is a tubular pipe having an outer diameter that is smaller than the inner diameter of the stuck drill pipe 116 that the pipe freeing tool 300 is being used to free from the wellbore 112.

As depicted in FIGS. 3A-3C, a side arm 304 is coupled to the surface of the downhole conveyance 302 of the pipe freeing tool 300. In some implementations, the side arm 304 is pivotally coupled to the downhole conveyance 302 of the pipe freeing tool 300. In some implementations, the side arm 304 is configured pivot between a retracted position 306, as depicted in FIG. 3B, and an extended position 308, as depicted in FIG. 3C. The side arm 304 can be coupled to the downhole conveyance 302 using one or more mechanical connectors, such as a hinges, pivot joints, ball joints, etc. In some implementations, the side arm 304 and downhole conveyance 302 are one integral, unitary body. The side arm 304 can be made of any suitable material, including, for example, metal or expandable material.

In some implementations, the longitudinal axis 320 of the side arm 304 is substantially parallel with the longitudinal axis 322 of the downhole conveyance 302 when the side arm 304 is in the fully retracted position 306, as depicted in FIG. 3B. In some implementations, the longitudinal axis 320 of the side arm 304 is substantially perpendicular with the longitudinal axis 322 of the downhole conveyance 302 when the side arm 304 is in the fully extended position 308, as depicted in FIG. 3C.

In some implementations, the side arm 304 can be activated by a power cable (not shown) to pivot between the retracted position 306 and an extended position 308. For example, the side arm 304 can be coupled to a control system (not shown) on the terranean surface 102 by a power cable, and the control system can be used to activate the side arm 304 of the pipe freeing tool 300 into the retracted position 306 or the extended position 308. In some implementations, an operator can use a control system to activate the side arm 304 to position the longitudinal axis 320 of the side arm along to a particular angle 324 relative to the longitudinal axis 322 of downhole conveyance 302. In some implementations, the position of the side arm 304 relative to the downhole conveyance 302 can be adjusted in increments of about 10 degrees. In some implementations, the side arm 304 can be positioned such that the angle 324 between the longitudinal axis 320 of the side arm 304 and the longitudinal axis 322 of the downhole conveyance 302 ranges from about 0 degrees to about 90 degree. As will be described in further detail herein, the side arm 304 can be activated to pivot between the retracted position 306 and the extended position 308 in order to apply a force to a stuck drill pipe 116 and free the stuck drill pipe 116 from the wellbore 112.

In some implementations, the pipe freeing tool 300 includes a circulating valve 360 that can be used to pump fluids, such as lubricant fluids or acid, into the wellbore 112 to help assist in freeing the drill pipe 116. In some implementations, fluids, such as lubricant pills or acid, are pumped through the drillstring 110 into the wellbore 112 to help assist in freeing the drill pipe 116. In some implementations, as depicted in FIGS. 3A-3C, the circulating valve 360 is installed above the side arm 306.

An example operation of the pipe freeing tool 300 is described with reference to FIGS. 4A-4D.

Figure 4A:
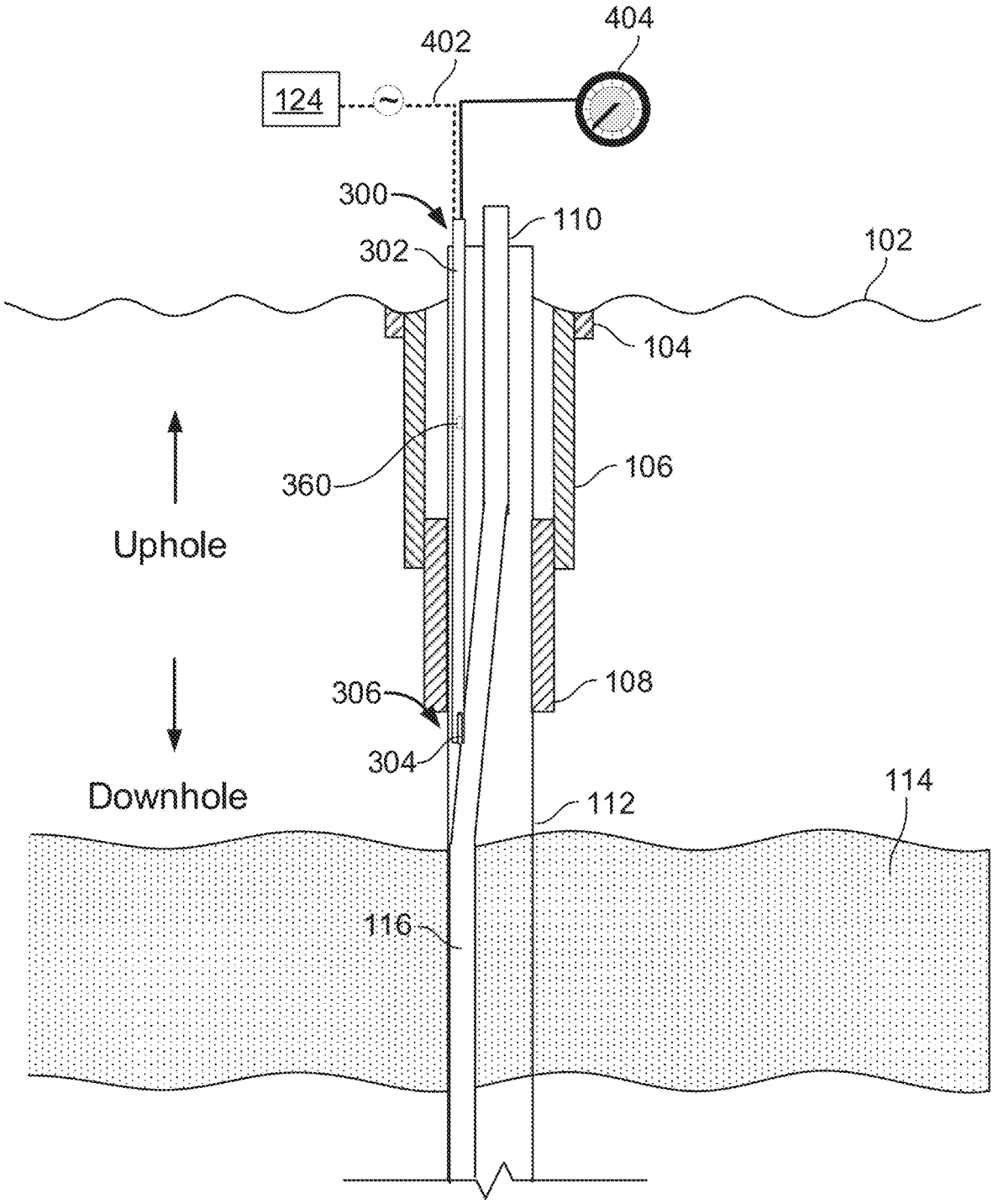
FIGS. 4A-4D are schematic illustrations of a wellbore system that includes the example tool of FIGS. 3A-3C.

In response to determining that a section of drill pipe 116 has become stuck against the side of the wellbore 112, the pipe freeing tool 300 can be conveyed through the annulus of the wellbore 112 to perform operations to free the stuck drill pipe 116. For example, as depicted in FIG. 4A, the downhole conveyance 302 can be lowered downhole through the annulus of the wellbore 112 to position the pipe freeing tool 300 between an open hole portion of the wellbore 112 and a section of the stuck drill pipe 116 proximate the stuck point. In some implementation, the pipe freeing tool 300 is positioned within the wellbore 112 as close as possible to the stuck point.

In some implementations, the pipe freeing tool 300 is continually lowered downhole into the wellbore 112 until it is determined that the pipe freeing tool 300 is positioned proximate the stuck point of the section of stuck drill pipe 116. In some implementations, the pipe freeing tool 300 is coupled to a surface weight indicator 404 that monitors the weight of the pipe freeing tool 300 as it is lowered through the wellbore 112. The weight of the pipe freeing tool 300 as measured by the weight indicator 404 will decrease once the pipe freeing tool 300 contacts the stuck section of drill pipe 116. Thus, by monitoring a weight indicator 404 coupled to the pipe freeing tool 300, an operator can determine when the pipe freeing tool 300 is positioned against the section of stuck drill pipe 116 proximate the stuck point. In some implementations, the weight indicator 404 is a Martin-Decker indicator. In some implementations, the pipe freeing tool 300 includes one or more sensors that can be used to determine whether the pipe freeing tool 300 is positioned against the section of stuck drill pipe 116 proximate the stuck point. In some implementations, a free point indicator tool is inserted downhole on a wireline to determine the stuck point prior to deployment of the pipe freeing tool 300 within the wellbore 112.

Once the pipe freeing tool 300 is positioned within the wellbore 112 in contact with the drill pipe 116 proximate the stuck point, the side arm 304 of the pipe freeing tool 300 can be activated to pivot and apply a force to the stuck drill pipe 116 in order to free the stuck drill pipe 116 from the surface of the wellbore 112. In some implementations, the pipe freeing tool 300 can be attached to a power cable 402, which can be used to active the side arm 304 to pivot inward or outward from the housing 102. As depicted in FIG. 4A, in some implementations, the pipe freeing tool 300 is communicably coupled to a control system 124 via the power cable 402, and the control system 124 can be used to activate the pipe freeing tool 300.

Figure 4B:
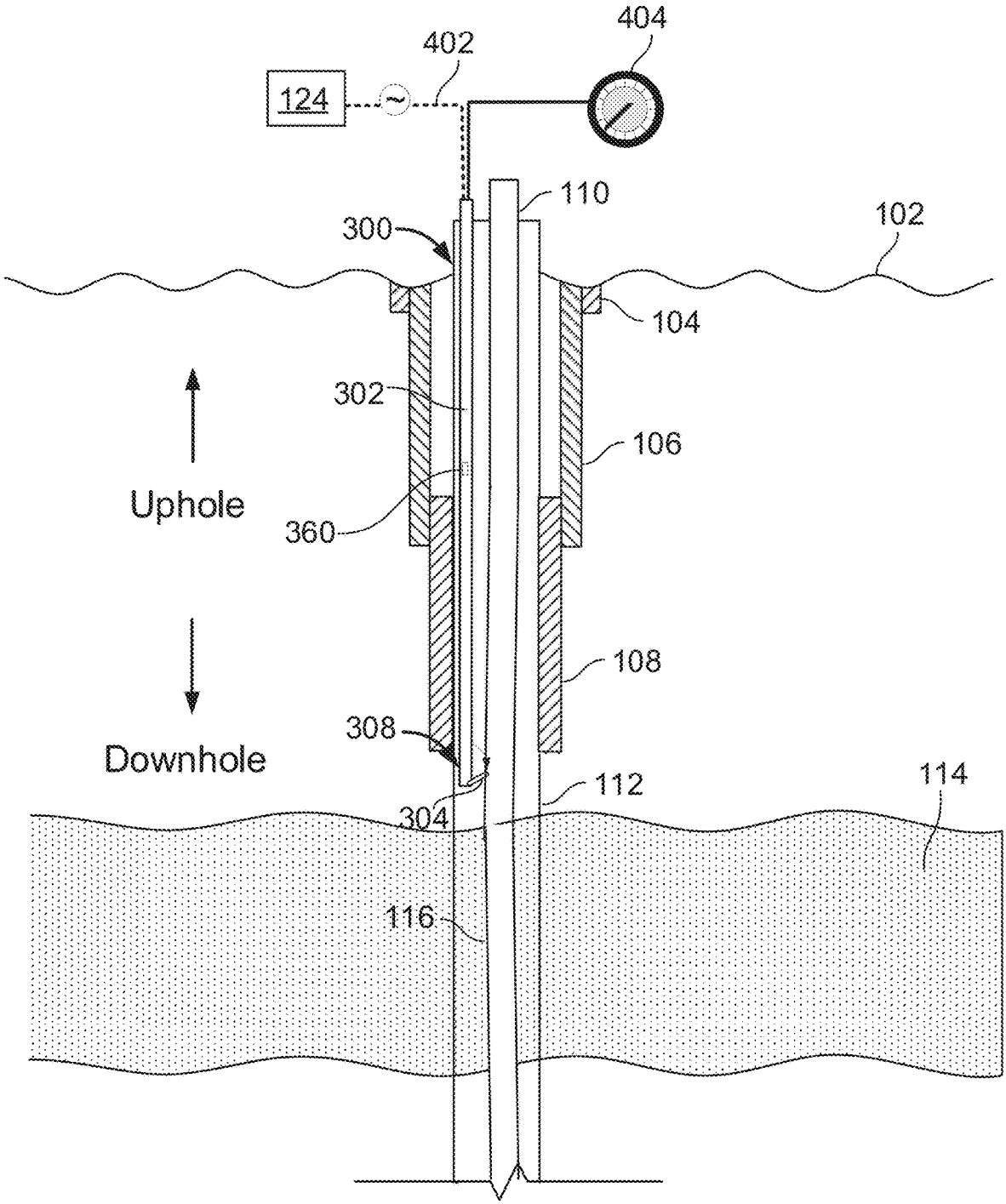

In some implementations, activating the pipe freeing tool 300 causes the side arm 304 to pivot away from the downhole conveyance 302 into an extended position 308, which causes the side arm 304 to push against the section of the stuck drill pipe 116 to push the stuck drill pipe 116 away from the surface of the wellbore 112. For example, as depicted in FIG. 4A, the pipe freeing tool 300 can be lowered into the wellbore 112 with the side arm 304 of the pipe freeing tool 300 in a retracted position 306 and the pipe freeing tool can be positioned within the wellbore 112 such that the side arm 304 of the pipe freeing tool 300 contacts the drill pipe 116 proximate the stuck point. Referring to FIG. 4B, once the pipe freeing tool 300 is positioned within the wellbore 112, the side arm 304 can be activated via the power cable 402 to pivot outwards to an extended position 308. As the side arm 304 pivots from the retracted position 306 depicted in FIG. 4A to the extended position 308 depicted in FIG. 4B, the side arm 304 applies a pushing force to the drill pipe 116 towards the center of the wellbore 112, which causes the section of stuck drill pipe 116 to be pushed away from the surface of the wellbore 112. As a result, the section of stuck drill pipe 116 is freed from the surface of the wellbore, as depicted in FIG. 4B.

In some implementations, the side arm 304 continues to pivot outwards until the side arm 304 is in a fully extended position 308.

Figure 4C:
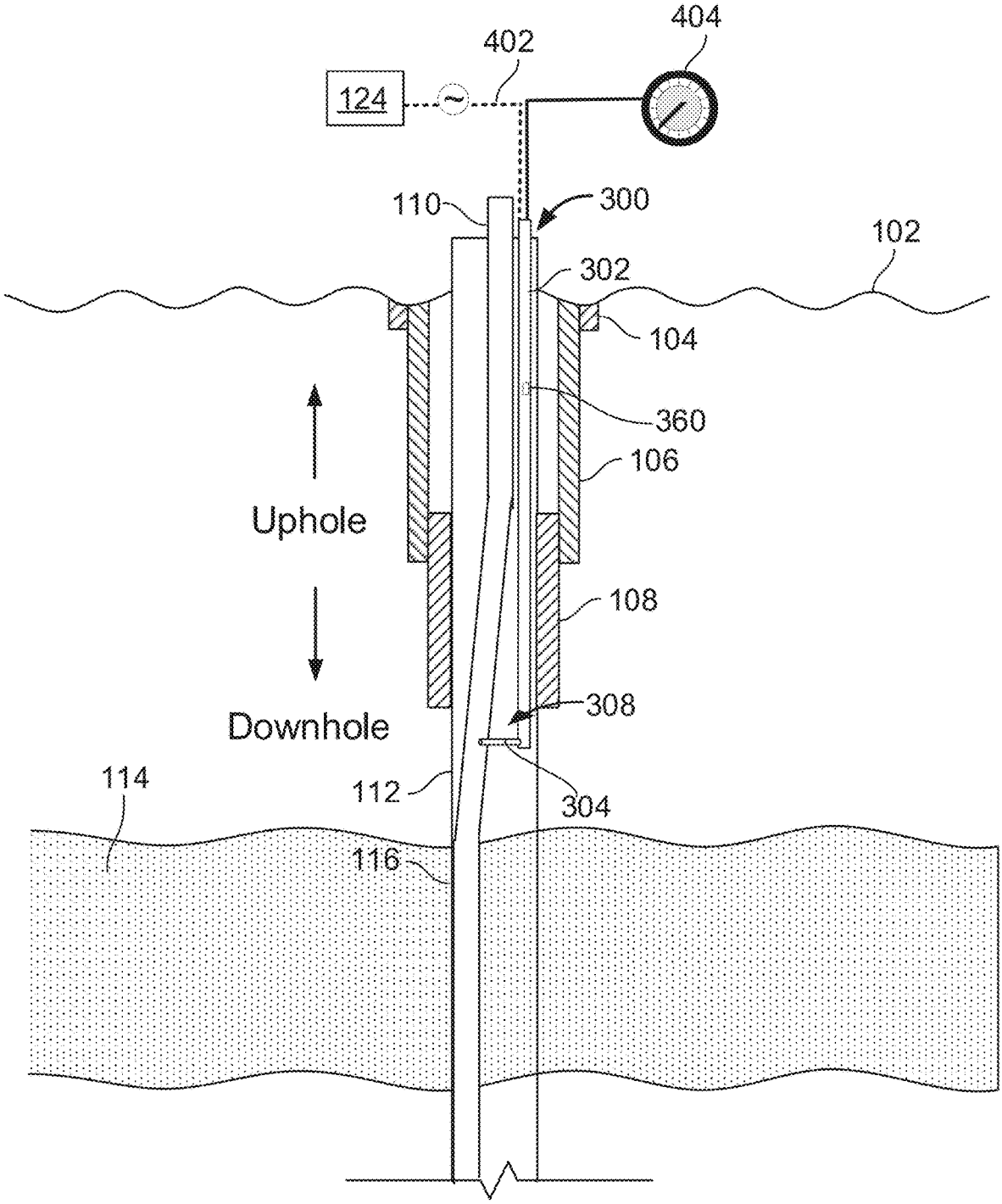
Figure 4D:
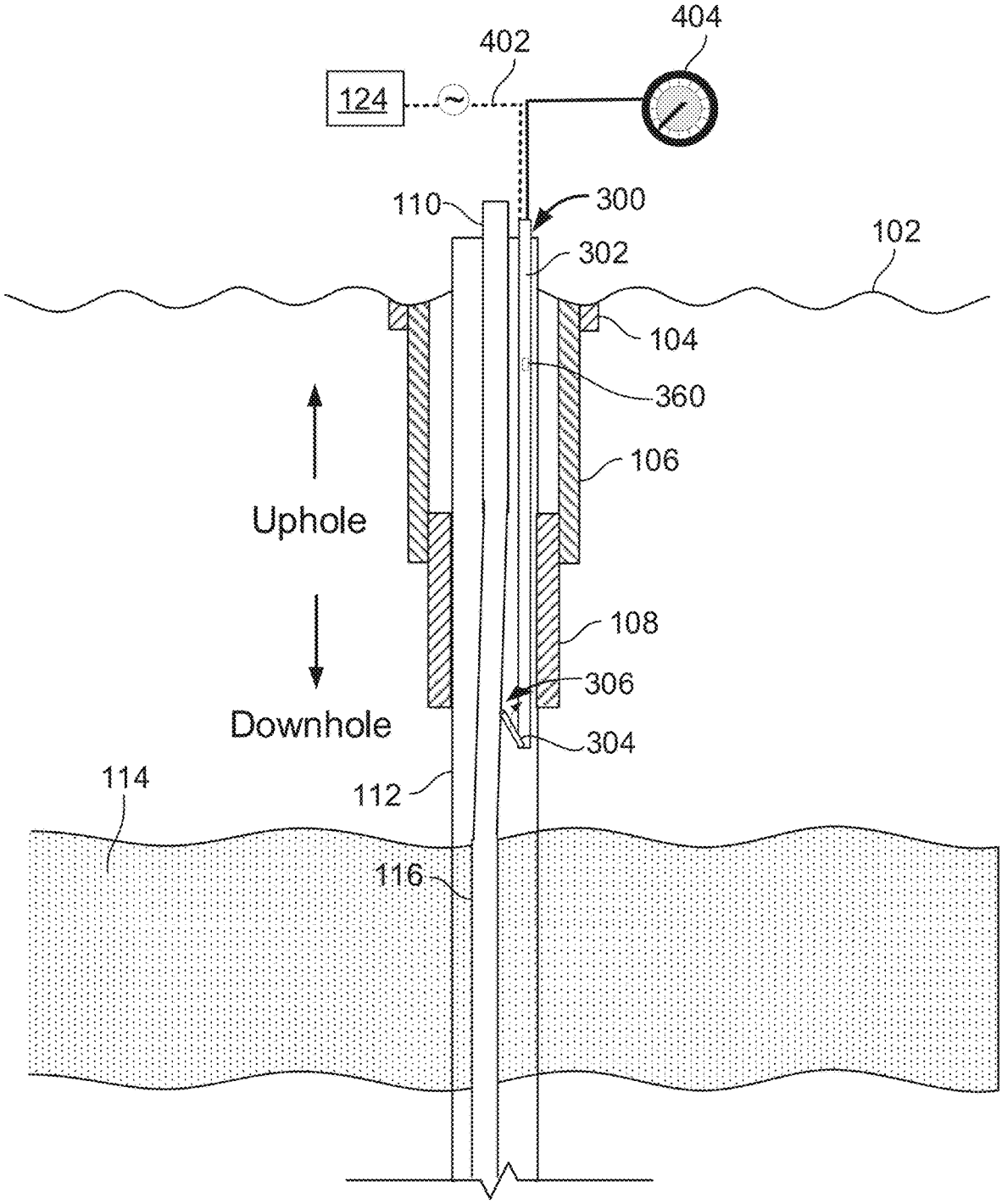

Referring to FIG. 4C, in some implementations, the side arm 304 latches onto the drill pipe 116, and activating the pipe freeing tool 300 causes the side arm 304 to pull the stuck drill pipe 116 away from the surface of the wellbore 112. For example, as depicted in FIG. 4C, the pipe freeing tool 300 can be lowered into the wellbore 112 with the side arm 304 in an extended position 308 and the pipe freeing tool 300 can be positioned within the wellbore 112 such that the side arm 304 of the pipe freeing tool 300 latches onto or otherwise attaches to a portion of the drill pipe 116 proximate the stuck point. Referring to FIG. 4D, once the pipe freeing tool 300 is positioned within the wellbore 112 and the side arm 304 of pipe freeing tool 300 is latched onto or otherwise coupled to the stuck drill pipe 116, the side arm 304 can be activated via the power cable 402 to pivot inwards towards the downhole conveyance 302, as depicted in FIG. 4D. As the side arm 304 pivots from the extended position 308 depicted in FIG. 4C to the retracted positioned depicted in FIG. 4D while coupled to the drill pipe 116, the side arm 304 pulls the drill pipe 116 towards the center of the wellbore 112, which causes the section of stuck drill pipe 116 to be pulled away from the surface of the wellbore 112. As a result, the section of stuck drill pipe 116 is freed from the surface of the wellbore 112, as depicted in FIG. 4D. In some implementations, the side arm 304 continues to pivot inwards until the side arm 304 is in a fully retracted position 306 against the downhole conveyance 302.

Once the section of stuck drill pipe 116 has been freed from the surface of the wellbore 112, the pipe freeing tool 300 can be raised out of the wellbore 112 and drilling operations within the wellbore can proceed.

Figure 5A:
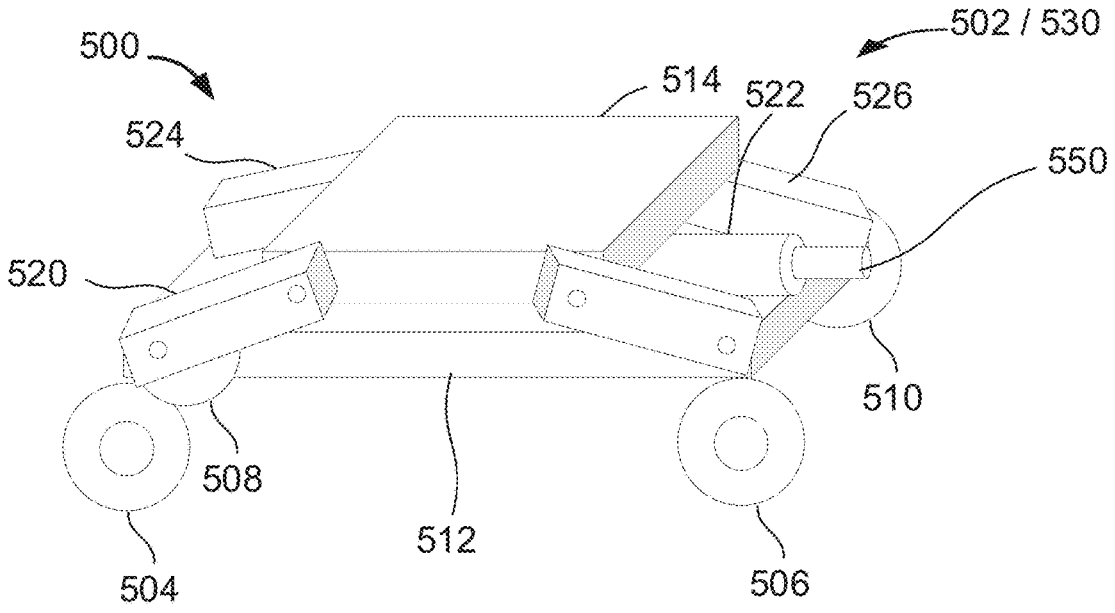
FIGS. 5A and 5B are schematic illustrations on an example tool for freeing a stuck pipe in a wellbore.
Figure 5B:
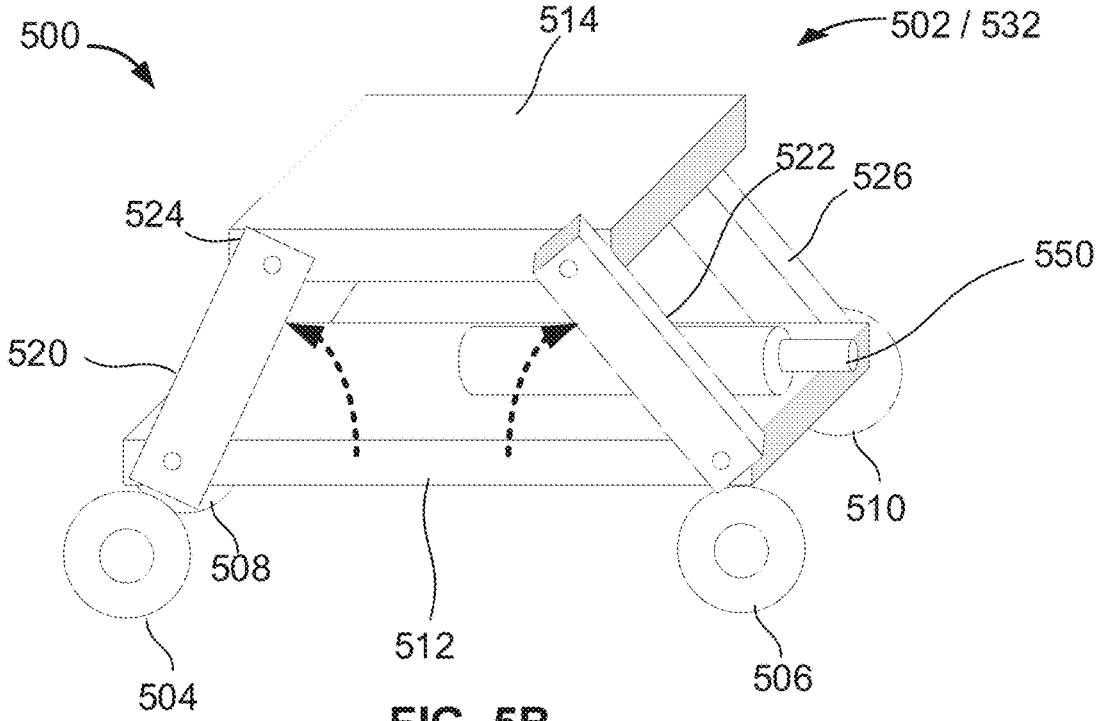

FIGS. 5A and 5B are schematic illustrations of example implementation of another tool 500 for freeing a stuck section of drill pipe from the surface of a wellbore. For example, in some aspects, the pipe freeing tool 500 may be used in the wellbore system 100 to free a stuck portion of the drill pipe 116 from the surface of the wellbore 112.

As can be seen in FIGS. 5A and 5B, the illustrated implementation of the pipe freeing tool 500 includes a jack 502 and a set of wheels 504, 506, 508, 510 coupled to the jack 502.

The jack 502 includes a base 512, a platform 514, and a set of lift arms 520, 522, 524, 526. As can be seen in FIGS. 5A and 5B, the lift arms 520, 522, 524, 526 are each pivotally coupled the base 512 at a first end to and are pivotally coupled to the platform 514 at a second, opposite end. The lift arms 520, 522, 524, 526 can be coupled to the downhole conveyance 302 using one or more mechanical fasteners, such as a screws, pins, etc.

As depicted in FIGS. 5A and 5B, each of the wheels 504, 506, 508, 510 are coupled to a respective corner of the base 512. As will be described in further detail herein, the wheels 504, 506, 508, 510 can enable the pipe freeing tool 500 to traverse along the surface of a wellbore to position the pipe freeing tool 500 proximate a stuck drill pipe. The wheels 504, 506, 508, 510 can be made of any suitable material, including, for example, rubber.

The pipe freeing tool can be raised and lowered between a lowered position and a raised position to apply a force to a stuck drill pipe. For example, as depicted in FIG. 5A, the lift arms 520, 522, 524, 526 be lowered to position the platform 514 of the pipe freeing tool 500 into a lowered position 530 against or close to the base 512 of the pipe freeing tool 500. As depicted in FIG. 5B, the lift arms 520, 522, 524, 526 can be raised to position the platform 514 of the pipe freeing tool 500 into a raised position 530 above the base 512 of the pipe freeing tool 500.

In some implementations, in additional to being raised and lowered, the platform 514 of the jack 502 can be rotated side to side about the base 512. In some implementations, the platform 514 can be rotated up to 180 degrees about the base 512. In some implementations, the rotation of the platform 514 about the base 512 is controlled by a control system (for example, control system 124 of FIGS. 6A-6D). Rotating the platform 514 about the base 512 can allow for improved positioning of the pipe freeing tool 500 against a stuck drill pipe 116 within the wellbore 112.

In some implementations, the pipe freeing tool 500 also includes a sand bailer 550 attached to the base 512 of the jack 502 and configured to remove debris from the wellbore 112. In some implementations, the sand bailer 550 is positioned on a front portion of the pipe freeing tool 500 and removes debris from the wellbore 112 in front of the pipe freeing tool 500 as the pipe freeing tool 500 traverses the wellbore 112. By removing debris from the wellbore 112, the sand bailer 550 allows for the pipe freeing tool 500 to travel more smoothly along the wellbore 112.

An example operation of the pipe freeing tool 500 is described with reference to FIGS. 6A-6D.

Figure 6A:
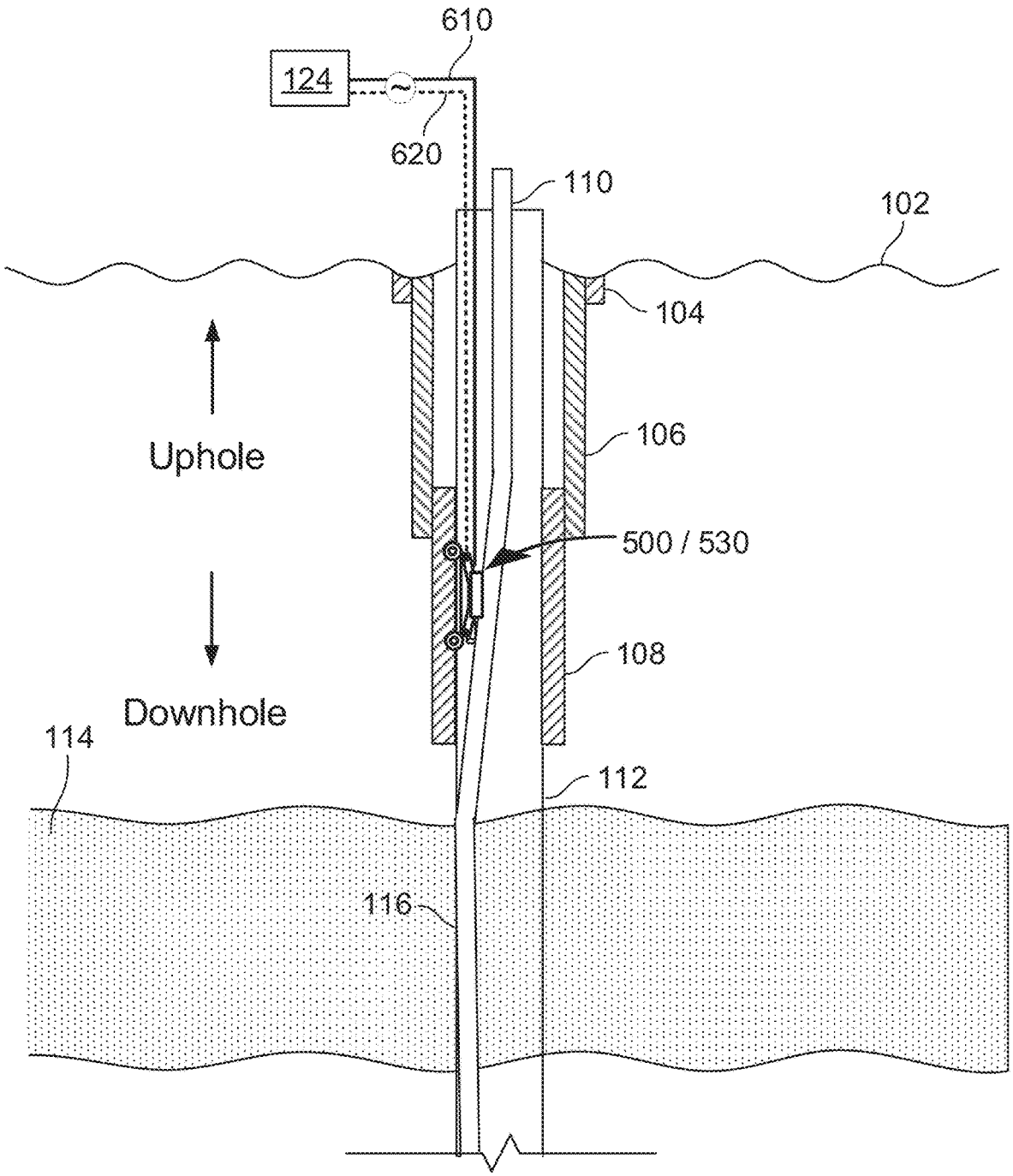
FIGS. 6A-6D are schematic illustrations of a wellbore system that includes the example tool of FIGS. 5A and 5B.

In response to determining that a section of drill pipe 116 has become stuck against the side of the wellbore 112, the pipe freeing tool 500 can be conveyed through the annulus of the wellbore 112 to perform operations to free the stuck drill pipe 116. For example, as depicted in FIG. 6A, the pipe freeing tool 500 can be lowered downhole through the annulus of the wellbore 112 to position the pipe freeing tool 500 between an open hole portion of the wellbore 112 and the stuck drill pipe 116 proximate the stuck point. In some implementation, the pipe freeing tool 500 is positioned within the wellbore 112 as close as possible to the stuck point As depicted in FIGS. 6A-6D, in some implementations, the pipe freeing tool 500 is coupled to a downhole conveyance 610 and is lowered into the wellbore 112 using the downhole conveyance 610. In some implementations, the downhole conveyance 610 may be a tubular work string made up of multiple tubing joints. For example, a tubular work string typically consists of sections of steel pipe, which are threaded so that they can interlock together. In alternative embodiments, the downhole conveyance 610 may be a wireline. In some examples, the downhole conveyance 610 may be an e-line. In some implementations, the downhole conveyance 610 may be coiled tubing.

In addition to using a downhole conveyance 610 to lower the pipe freeing tool 500 into the wellbore 112, the wheels 504, 506, 508, 510 of the pipe freeing tool 500 allow the pipe freeing tool 500 to roll along the surface of the wellbore 112. By rolling the pipe freeing tool 500 along the surface of the wellbore 112 using wheels 504, 506, 508, 510, the risk of damage to the pipe freeing tool 500 can be minimized.

As previously discussed, in some implementations, the pipe freeing tool 500 also includes a sand bailer 550 configured to remove debris from the wellbore 112. For example, the sand bailer 550 can be positioned on a front portion of the pipe freeing tool 500 and can be operated as the pipe freeing tool 500 is lowered into the wellbore 112 in order to remove debris from the wellbore 112 in the path of travel of the pipe freeing tool 500. By removing debris from the wellbore 112, the sand bailer 550 allows for the pipe freeing tool 500 to travel more smoothly along the wellbore 112, further reducing the risk of damage to the pipe freeing tool 500.

In some implementations, the pipe freeing tool 500 is continually lowered downhole into the wellbore 112 and rolled along the surface of the wellbore 112 until it is determined that the pipe freeing tool 500 is positioned proximate the stuck point of the drill pipe 116. In some implementations, a caliber (not shown) coupled to the pipe freeing tool 500 can be used to determine that the pipe freeing tool 500 is positioned proximate the stuck point of the stuck drill pipe 116. As depicted in FIG. 6A, in some implementations, the pipe freeing tool 500 is lowered downhole through the wellbore 112 in the lowered position 530 with the lift arms 520, 522, 524, 526 lowered.

Figure 6B:
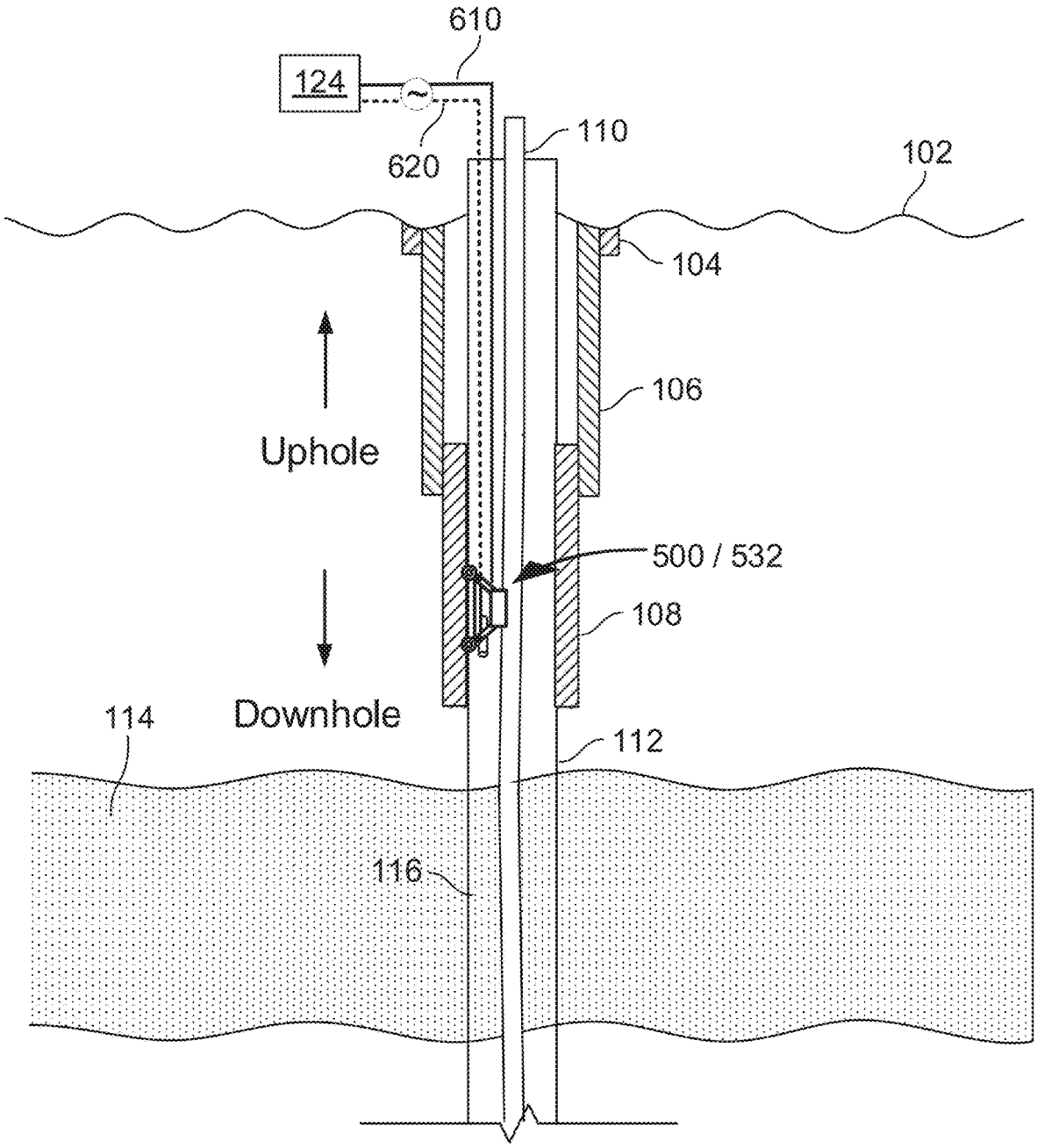

As depicted in FIG. 6B, once the pipe freeing tool 500 is positioned within the wellbore 112 proximate the stuck point of the drill pipe 116, the jack 502 of the pipe freeing tool 500 can be activated to raise the lift arms 520, 522, 524, 526 and position the jack 502 in the raised position 532. In some implementations, the jack 502 of the pipe freeing tool 500 is activated hydraulically. In some implementations, the jack 502 of the pipe freeing tool 500 is activated mechanically. For example, in some implementations, once the pipe freeing tool 500 is properly positioned in the wellbore 112 proximate the stuck point of the drill pipe 116, additional weight is added to the pipe freeing tool 500 and rotation is applied to the pipe freeing tool 500 using the downhole conveyance 600 to activate the jack 502 and raise the lift arms 520, 522, 524, 526, which raises the jack 502 from a lowered position 530 to a raised position 532. In some implementations, the jack 502 is activated and raised from the lowered position 530 to the raised position 532 by dropping a ball through an annulus of a downhole conveyance 610 coupled to the pipe freeing tool 500, which increases the pressure within the downhole conveyance 610 and activates the jack 502 into a raised position 532. In some implementations, the jack 502 is activated and raised from the lowered position 530 to the raised position 532 using a control line 620 coupled to the pipe freeing tool 500. In some implementations, the control line 620 communicably couples the pipe freeing tool 500 to a control system 124, and the control system 124 can be used to initiate activation of the jack 502. In some implementations, the control system 124 can control electrical power and/or hydraulics supplied to the pipe freeing tool 500.

Referring to FIG. 6B, as the jack 502 is activated and the lift arms 520, 522, 524, 526 raise the jack 502 from a lowered position 530 to a raised position 532, the platform 514 of the jack 502 contacts and applies a force to the drill pipe 116 proximate the stuck point. As the lift arm 520, 522, 524, 526 continue to be raised, the platform 514 of the jack 502 pushes the stuck drill pipe 116 away from the surface of the wellbore 112 to free the stuck drill pipe 116, as depicted in FIG. 6B.

In some implementations, the lift arms 520, 522, 524, 526 continue to raise until the platform 514 of the jack 502 is in a fully raised position 532. In some implementations, an operator can use the control system 124 to set a particular height for the platform 514 relative to the base 512 of the jack 502, and, once the jack 502 is activated, the lift arms 520, 522, 524, 526 continue to raise until the platform 514 is positioned at the selected height relative to the base 512.

Figure 6C:
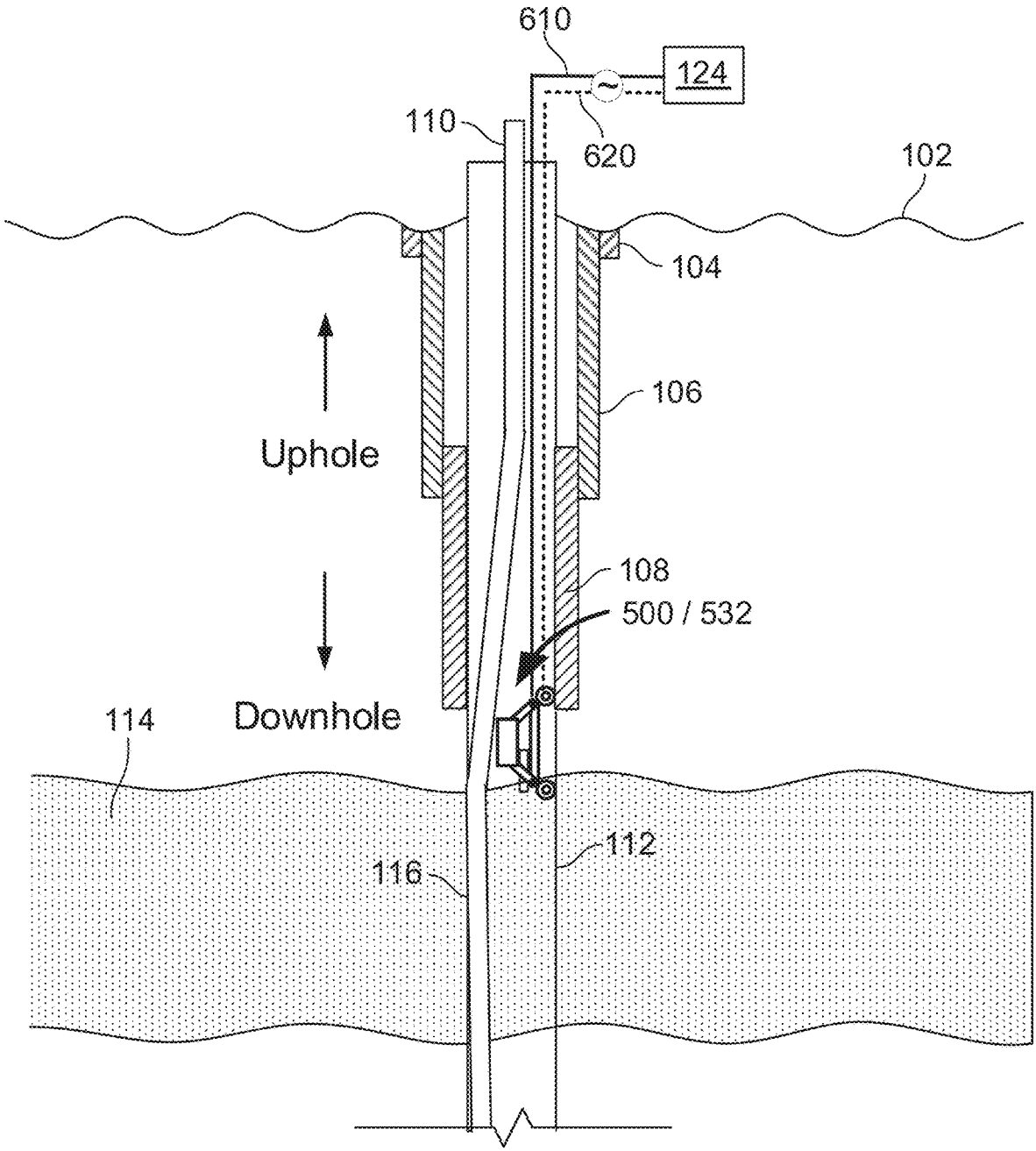
Figure 6D:
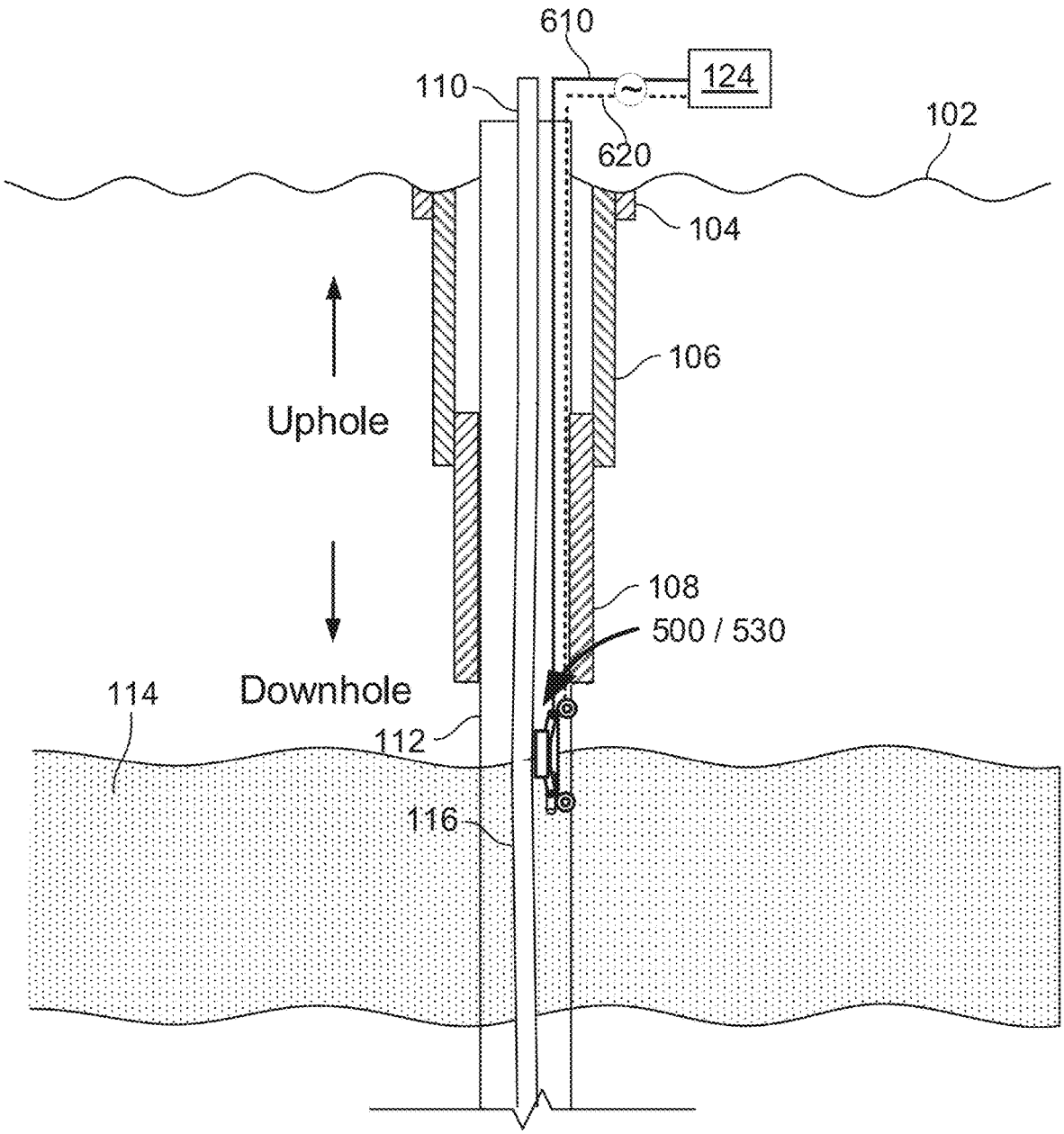

Referring to FIGS. 6C and 6D, in some implementations, the jack 502 is lowered into the wellbore 112 in a raised position 532 and couples to the stuck drill pipe 116 to apply a pulling force to the drill pipe 116 to free the stuck drill pipe 116 from the surface of the wellbore 112. For example, as depicted in FIG. 6C, in some implementations, the pipe freeing tool 500 is lowered downhole through the wellbore 112 in the raised position 532 with the lift arms 520, 522, 524, 526 raised. The pipe freeing tool 500 can be continually lowered through the wellbore 112 using the downhole conveyance 610 until it is determined (for example, using a caliber) that the pipe freeing tool 500 is positioned proximate the stuck point of the stuck drill pipe 116 and the platform 514 of the jack 502 is in contact with the stuck drill pipe 116.

Once the pipe freeing tool 500 is lowered into the wellbore 112 with the jack 502 in an raised position 532 and positioned within the wellbore 112 such that platform 514 of the jack 502 is in contact with the stuck drill pipe 116, the platform 314 can latch onto or otherwise couple to a portion of the stuck drill pipe 116 proximate the stuck point.

As depicted in FIG. 6D, once the pipe freeing tool 500 is positioned within the wellbore 112 proximate the stuck point and the platform 514 is coupled to the stuck drill pipe 116, the jack 502 of the pipe freeing tool 500 can be activated to lower the lift arms 520, 522, 524, 526 of the jack 502, which lowers the platform 514 of the jack 502 into a lowered position 530. As the lift arm 520, 522, 524, 526 continue to be lowered, the platform 514 of the jack 502 coupled to the drill pipe 116 pulls the stuck drill pipe 116 away from the surface of the wellbore 112 to free the stuck drill pipe 116 from the surface of the wellbore 112, as depicted in FIG. 6D.

In some implementations, the lift arms 520, 522, 524, 526 continue to lower until the platform 514 of the jack 502 is in a fully lowered position 530. In some implementations, an operator can use the control system 124 to set a particular height for the platform 514 relative to the base 512 of the jack 502, and, once the jack 502 is activated, the lift arms 520, 522, 524, 526 continue to lower until the platform 514 is at the selected height relative to the base 512.

As the lift arms 520, 522, 524, 526 are raised or lowered during activation of the jack 502 within the wellbore 112, the wheels 504, 506, 508, 510 of the pipe freeing tool 500 remain in contact with the wellbore 112. In addition, the wheels 504, 506, 508, 510 of the pipe freeing tool 500 can function to reduce the amount of friction between the pipe freeing tool 500 and the wellbore 112.

Once the section of stuck drill pipe 116 has been freed from the surface of the wellbore 112, the pipe freeing tool 500 can be raised out of the wellbore 112 and drilling operations within the wellbore can proceed. In some implementations, the platform 514 of the pipe freeing tool 500 is lowered into the lowered position 530 prior to raising the pipe freeing tool 500 uphole out of the wellbore 112.

While the pipe freeing tool 500 has been depicted as including four wheels 504, 506, 508, 510, other numbers of wheels can be included in the pipe freeing tool 500. In addition, while the pipe freeing tool 500 has been depicted as including four lift arms 520, 522, 524, 526, other numbers of lift arms can be included in the pipe freeing tool 500

Figure 7:
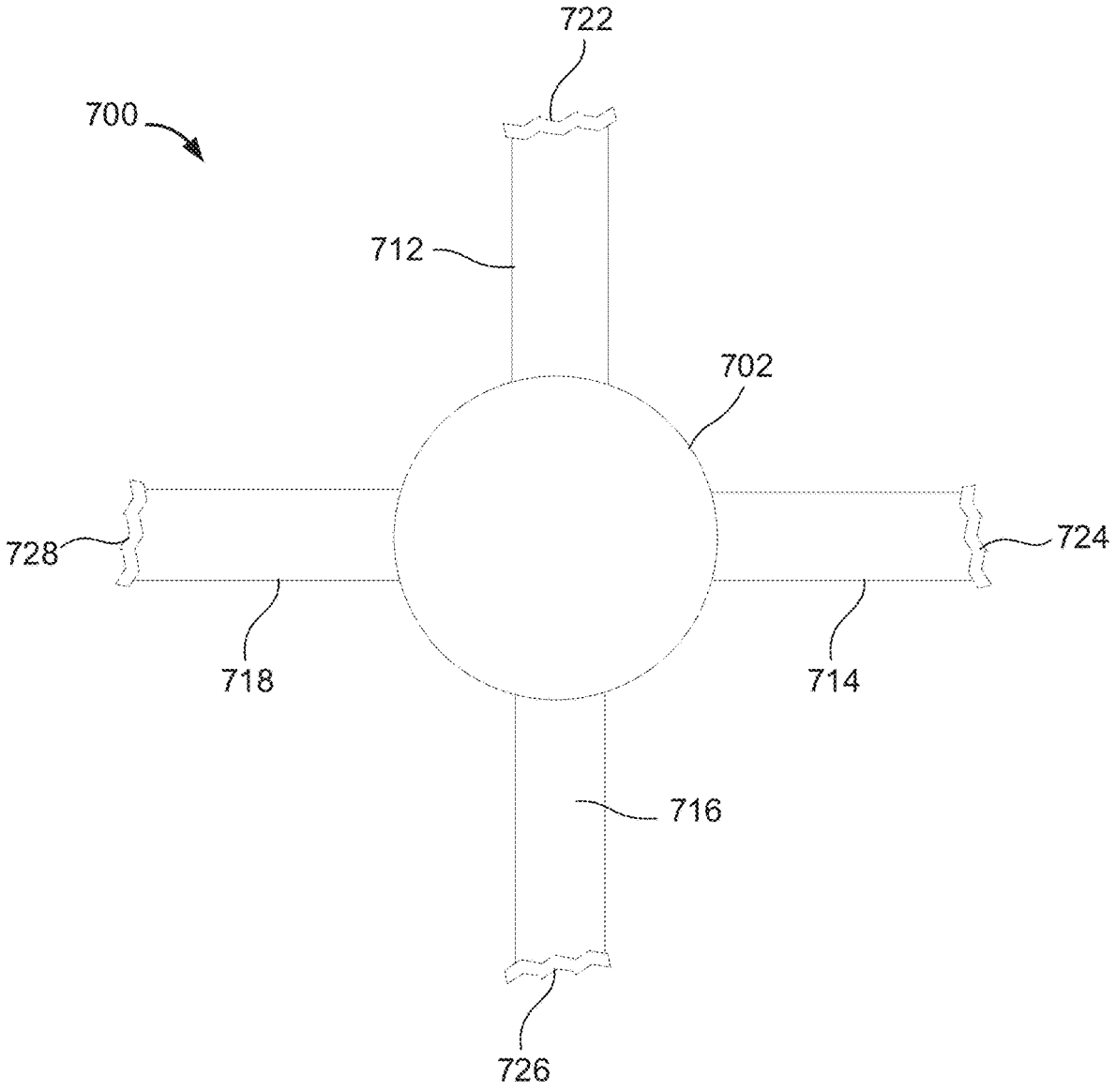
FIG. 7 is a schematic illustration of an example tool for freeing a stuck pipe in wellbore.

FIG. 7 is schematic illustration of a top view of an example implementation of another tool 700 for freeing a stuck section of drill pipe from the surface a wellbore. For example, in some aspects, the pipe freeing tool 700 may be used in the wellbore system 100 to free a stuck portion of the drill pipe 116 from the surface of the wellbore 112.

As can be seen in FIG. 7, the illustrated implementation of the pipe freeing tool 700 includes a body 702 and a set of arms 712, 714, 716, 718 (or more or fewer arms) coupled to and projecting from the body 702. The body 702 of the pipe freeing tool 702 can be made of any suitable material, including, for example, metal or expandable materials.

As will be described in further detail herein, each of the arms 712, 714, 716, 718 of the pipe freeing tool 700 is configured to extend outward from the body 702 of the pipe freeing tool 700 into an extended position in order to apply a force to a stuck drill pipe 116 and push the stuck drill pipe 116 away from the surface of the wellbore 112. In some implementations, the length of the arms 704, 706 708, 710 of the pipe freeing tool 700 is sized based on the size of the wellbore 112 that the pipe freeing tool 700 is configured to be deployed within. For example, pipe freeing tools 700 configured to be used in wider wellbores 112 can have longer arms 712, 714, 716, 718, whereas pipe freeing tools 700 configured to be used in narrower wellbores can have shorter arms 712, 714, 716, 718. The fully extended length of the arms 712, 714, 716, 718 can range from about 0.5 in to approximately the diameter of the wellbore. The arms 712, 714, 716, 718 can be made of any suitable material, including, for example, metal or expandable materials.

As depicted in FIG. 7, each arm 712, 714, 716, 718 of the pipe freeing tool 700 is coupled to the body 702 of the pipe freeing tool 500 at a first end and includes a cutting edge 722, 724, 726, 728 at a second, opposite end. The cutting edges 722, 724, 726, 728 of the arms 712, 714, 716, 718 of the pipe freeing tool 700 can be configured to pierce through the wall of a stuck drill pipe. In some implementations, the cutting edges 722, 724, 726, 728 are formed onto ends of the arms 712, 714, 716, 718 such that the cutting edges 722, 724, 726, 728 are integral with the arms 712, 714, 716, 718. The cutting edges 722, 724, 726, 728 can be made of any suitable material, including, for example, ceramic materials and ceramic composite materials.

An example operation of the pipe freeing tool 700 is described with reference to FIGS. 8A and 8B.

In response to determining that a section of drill pipe 116 along a drillstring has become stuck against the side of the wellbore 112, the pipe freeing tool 700 can be conveyed through the annulus of the drillstring (for example, drillstring 110 of FIG. 1) until the pipe freeing tool 700 is positioned within the annulus 802 of the stuck drill pipe 116. For example, as depicted in FIG. 8A, the pipe freeing tool 700 can be conveyed through the annulus of the drillstring until the pipe freeing tool 700 is positioned within the annulus 802 of the stuck drill pipe 116 proximate the stuck point. As can be seen in FIG. 8A, as the pipe freeing tool 700 is being lowered downhole into the annulus 802 of the stuck drill pipe 116, the arms 712, 714, 716, 718 of the pipe freeing tool 700 are maintained in a retracted position 730.

In some implementations, the body 702 of the pipe freeing tool 700 is coupled to a downhole conveyance 810 and the pipe freeing tool 700 is lowered into the wellbore 112 using the downhole conveyance 810. For example, in some implementations, the downhole conveyance 810 coupled to the body 702 of the pipe freeing tool 700 is a pipe with an outer diameter that is smaller than the inner diameter of the stuck drill pipe 116, and the downhole conveyance 810 is used to lower the pipe freeing tool 700 downhole through the annulus of the drillstring into the annulus 802 of the stuck drill pipe 116. In some implementations, the downhole conveyance 810 used to convey the pipe freeing tool 700 may be a tubular work string made up of multiple tubing joints. For example, a tubular work string typically consists of sections of steel pipe, which are threaded so that they can interlock together. In alternative embodiments, the downhole conveyance 810 used to convey the pipe freeing tool 700 may be a wireline. In some examples, the downhole conveyance 810 used to convey the pipe freeing tool 700 may be an e-line. In some implementations, the downhole conveyance 810 used to convey the pipe freeing tool 700 may be coiled tubing.

The pipe freeing tool 700 can be continually lowered downhole through the annulus of the drillstring until it is determined that the pipe freeing tool 700 is positioned within the annulus 802 of the stuck drill pipe 116 proximate the stuck point of the stuck drill pipe 116. In some implementations, the pipe freeing tool 700 is coupled to a surface weight indicator (for example, surface weight indicator 404 of FIGS. 4A-4D) that monitors the weight of the pipe freeing tool 700 as it is lowered into the annulus 802 of the stuck drill pipe 116. Upon the pipe freeing tool 700 being positioned within the stuck drill pipe 116, the weight of the pipe freeing tool 700 as measured by the weight indicator will decrease. Thus, by monitoring a weight indicator coupled to the pipe freeing tool 700, an operator can determine when the pipe freeing tool 700 is positioned within the section of stuck drill pipe 116 proximate the stuck point. In some implementations, the weight indicator is a Martin-Decker indicator. In some implementations, a free point indicator tool is run downhole on a wireline to determine the stuck point prior to positioning the pipe freeing tool 700 within the wellbore 112.

Figure 8A:
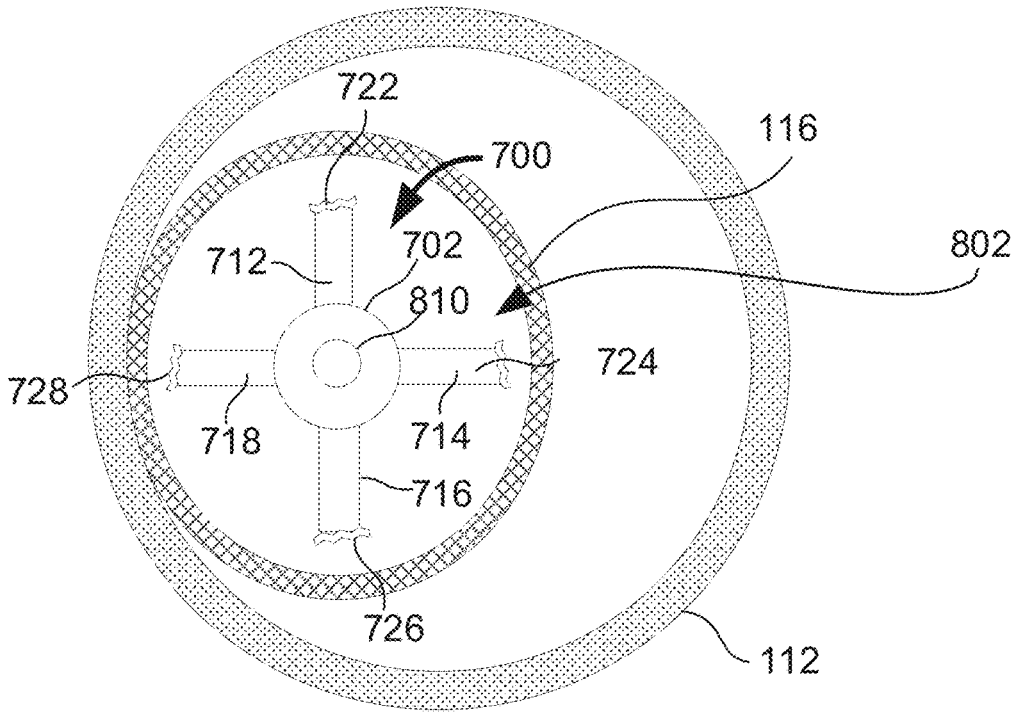
FIGS. 8A and 8B are schematic top views of a wellbore system that includes the example tool of FIG. 7.
Figure 8B:
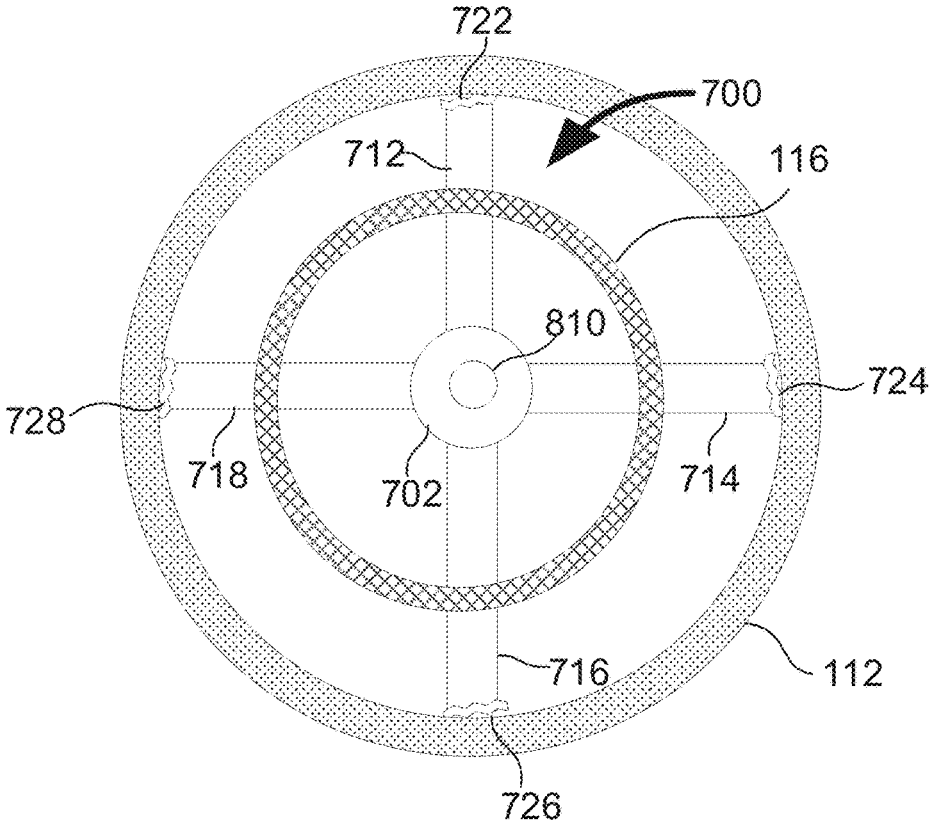

Once the pipe freeing tool 700 is positioned within the annulus 802 of the stuck drill pipe 116 proximate the stuck point with the arms 712, 714, 716, 718 in the retracted position 730, as depicted in FIG. 8A, the arms 712, 714, 716, 718 of the pipe freeing tool 700 can be activated to extend outward from the body 702 of the pipe freeing tool 700. As can be seen in FIG. 8B, as the arms 712, 714, 716, 718 extend outward from the body 702 of the pipe freeing tool 700, the cutting edges 722, 724, 726, 728 on the ends of each of the arms 712, 714, 716, 718 pierce through the wall of the stuck drill pipe 116, allowing the arms 712, 714, 716, 718 to extend through the wall of the stuck drill pipe 116 and outwards towards the surface of the wellbore 112. In some implementations, the arms 712, 714, 716, 718 are telescoping arms that telescope outwards from the body 702 of the pipe freeing tool 700 from a retracted position 730, as depicted in FIG. 8A, to an extended position 732, as depicted in FIG. 8B.

In some implementations, the arms 712, 714, 716, 718 of the pipe freeing tool 700 are activated to extend from a retracted position 730 to an extended position 732 using a power cable coupled to the pipe freeing tool 700. In some implementations, the arms 712, 714, 716, 718 of the pipe freeing tool 700 are activated to extend from a retracted position 730 to an extended position 732 by rotating a downhole conveyance coupled to the pipe freeing tool 700, which cause the arms 712, 714, 716, 718 to extend outward from the body 702 of the pipe freeing tool 700.

In some implementations, the arms 712, 714, 716, 718 of the pipe freeing tool 700 continue to extend outward until the cutting edge 722, 724, 726, 728 of each of the arms 712, 714, 716, 718 contacts the surface of the wellbore 112. In some implementations, the arms 712, 714, 716, 718 continue to extend outward until the arms 712, 714, 716, 718 are positioned in a fully extended position 732, as depicted in FIG. 8B. For example, as previously discussed, in some implementations, the length of the arms 704, 706 708, 710 of the pipe freeing tool 700 is sized based on the size of the wellbore 112 that the pipe freeing tool 700 is configured to be deployed within. As such, when the arms 712, 714, 716, 718 are in the fully extended position 732, the cutting edge 722, 724, 726, 728 of each of the arms 712, 714, 716, 718 contacts the surface of the wellbore 112, as depicted in FIG. 8B. In some implementations, an operator can use a control system to set a particular length for each of the arms 712, 714, 716, 718 to extend outward from the body 702 in the fully extended position 732 (for example, based on the size of the wellbore 112), and, once activated, the arms 712, 714, 716, 718 continue to extend outward from the body 702 until each arm 712, 714, 716, 718 has extended to the predetermined length relative to the body 702 of the pipe freeing tool 700. In some implementations, the predetermined extended length of the arms 712, 714, 716, 718 relative to the body 702 is based on the size of the wellbore 112.

As one or more of the arms 712, 714, 716, 718 extend outward and contact the surface of the wellbore 112, the arms 712, 714, 716, 718 contacting the wellbore will begin to apply a pushing force against the wall of the drill pipe 116, which pushes the stuck drill pipe 116 away from the surface of the wellbore 112 towards the center of the wellbore 112. For example, as depicted in FIG. 8A, arm 718 of the pipe freeing tool 700 is initially positioned closest to the surface of the wellbore 112 of arms 712, 714, 716, 718. As a result, as the arms 712, 714, 716, 718 of the pipe freeing tool 700 are activated and extend outward from the body 702, arm 718 contacts the wellbore 112 before arms 712, 714, 716 contact the wellbore 112. As arm 718 continues to extend outwards after contacting the wellbore 112, arm 718 applies a pushing force to the wall of the stuck pipe 116 that causes the stuck pipe 116 to be freed from the surface of the wellbore 112 and move towards the center of the wellbore 112, as depicted in FIG. 8B.

Once the section of stuck drill pipe 116 has been freed from the surface of the wellbore 112, the pipe freeing tool 700 can be raised out of the wellbore 112 and drilling operations within the wellbore can proceed. In some implementations, the arms 712, 714, 716, 178 of the pipe freeing tool 700 are returned to the retracted position 730, as shown in FIG. 8A, prior to raising the pipe freeing tool 700 uphole out of the wellbore 112.

Figure 9A:
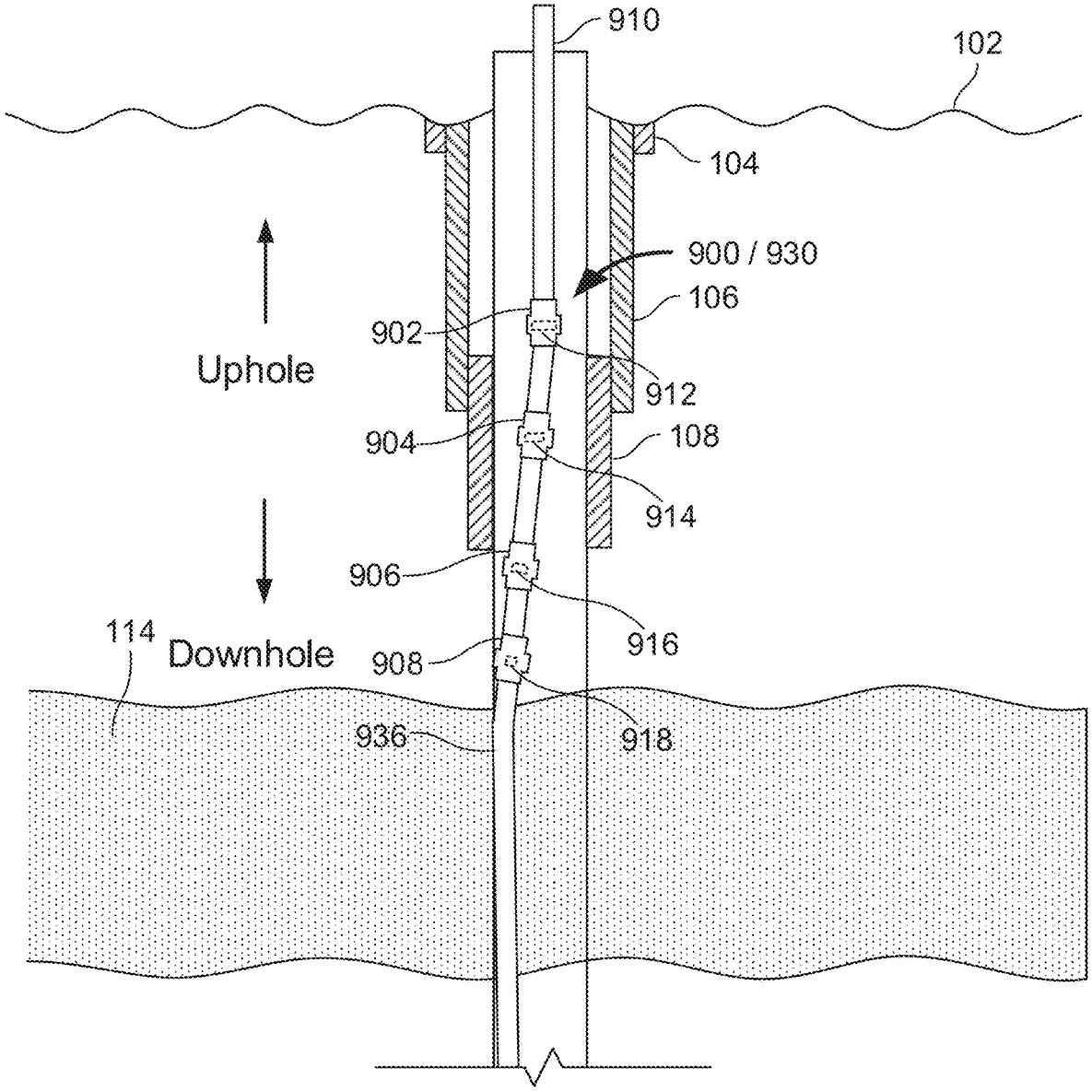
FIGS. 9A-9C are schematic illustrations of a wellbore system that includes an example tool for freeing a stuck pipe in a wellbore.
Figure 9B:
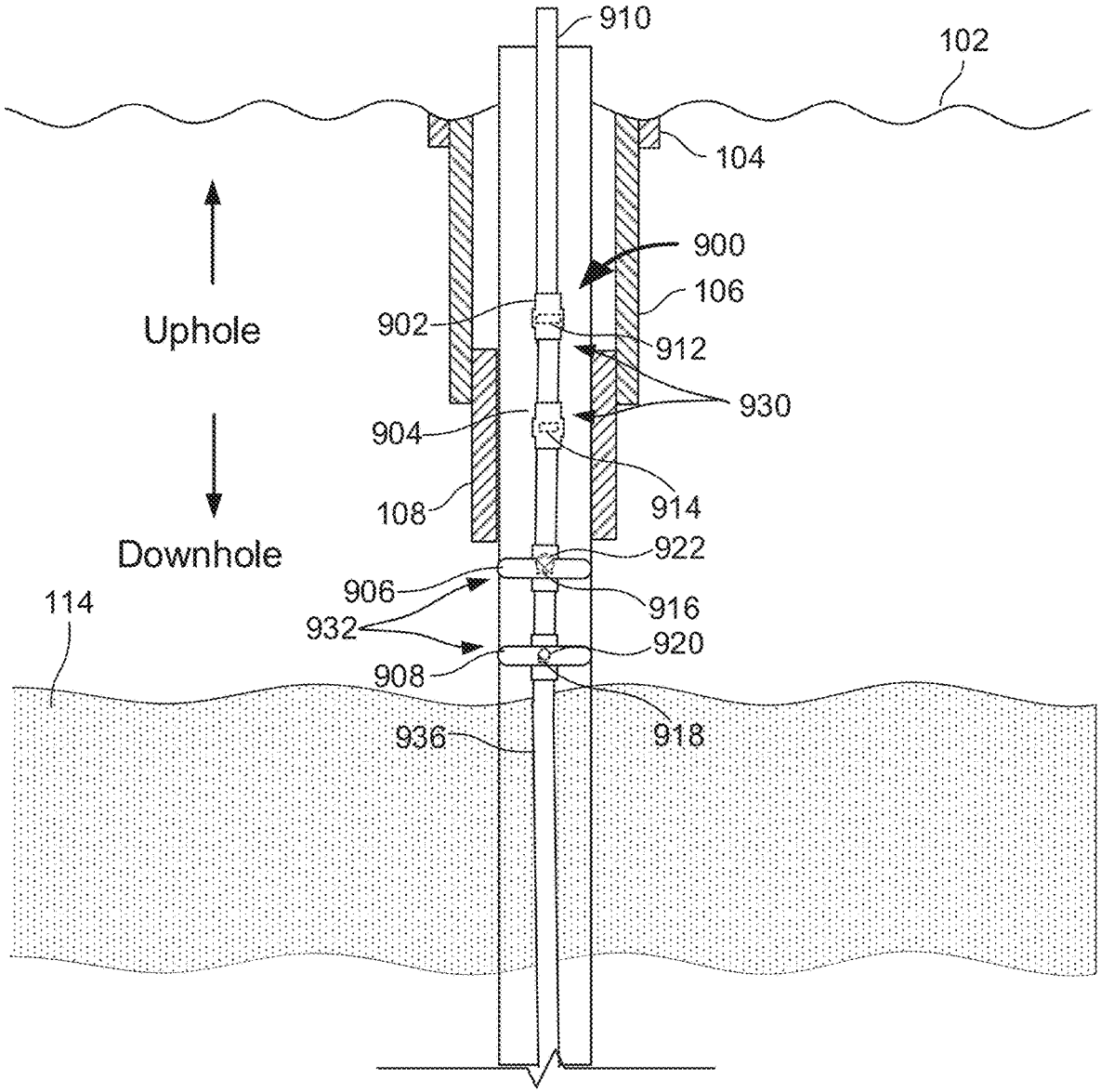
Figure 9C:
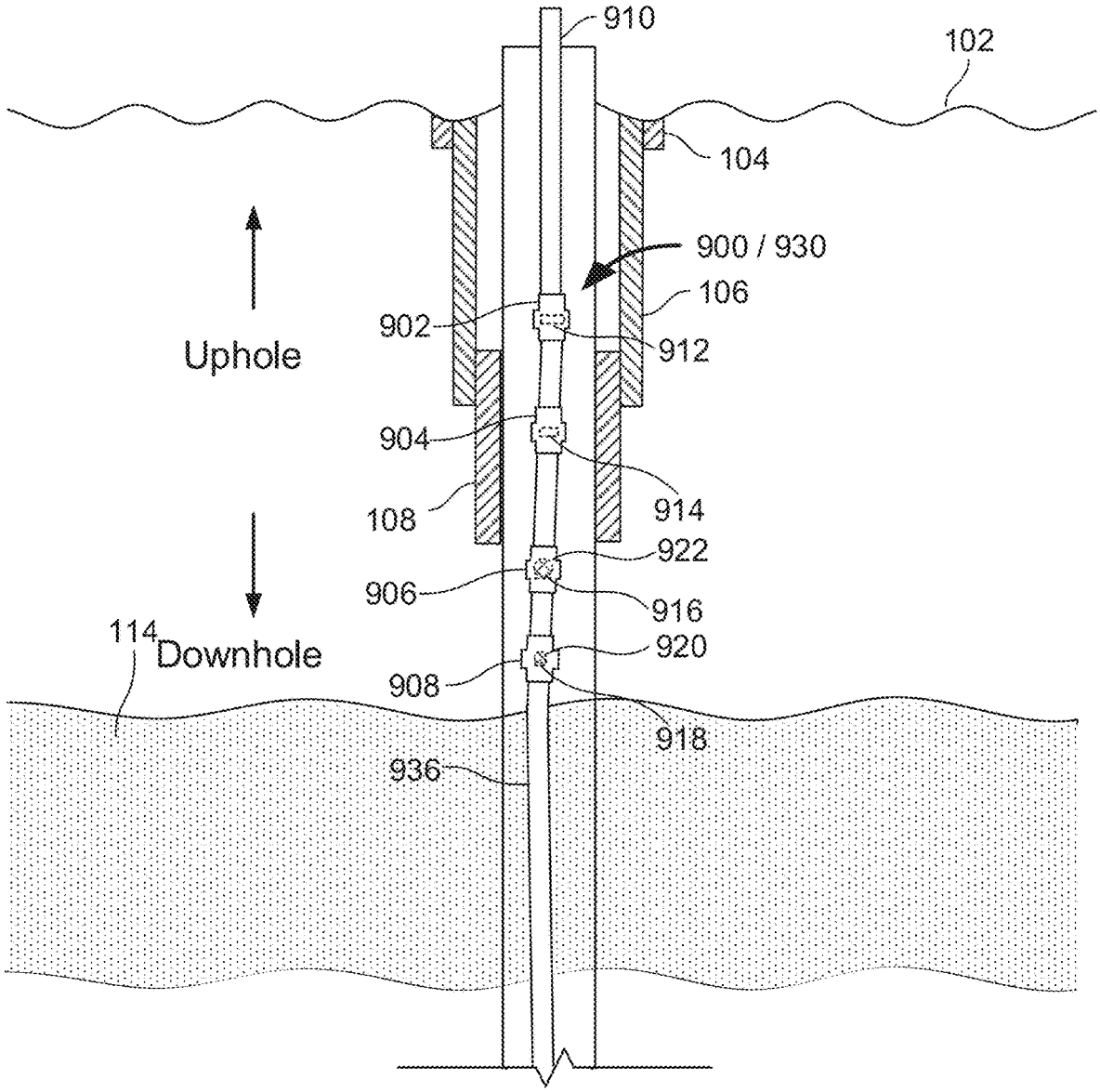

FIGS. 9A-9C are schematic illustrations of an example implementation of another tool 900 for freeing a stuck section of drill pipe from the surface of a wellbore.

As can be seen in FIG. 9A, the illustrated implementation of the pipe freeing tool 900 includes a series of expandable disc elements 902, 904, 906, 908 positioned circumferentially along and coupled to one or more drill pipes 916 of a drillstring 910. Each of the expandable disc elements 902, 904, 906, 908 can be made of any expandable metal material. In some embodiments, the expandable disc elements 902, 904, 906, 908 are each made of an expandable metal material capable of withstanding high forces.

The expandable disc elements 902, 904, 906, 908 are each configured to be selectively activated into an expanded configuration in order to free stuck drill pipe 936 along the drillstring 910 from the surface of the wellbore 112. For example, as depicted in FIG. 9A, each of the expandable disc elements 902, 904, 906, 908 includes a respective internal seat 912, 914, 916, 918 that is configured to receive a ball of a particular size or diameter, which activates the respective expandable disc element 902, 904, 906, 908 into an expanded configuration. As can be seen in FIG. 9A, the width of the seat 912, 914, 916, 918 of each expandable disc element 902, 904, 906, 908 is different from the width of the seat 912, 914, 916, 918 of the other disc elements 902, 904, 906, 908 along the drillstring 910.

In some implementations, the uppermost (furthest uphole) disc element has the widest seat and the bottommost (furthest downhole) disc element has the narrowest seat, with the seats of the expandable disc elements between the uppermost element and lowermost element having seats that decrease in width for each successive element further downhole. As described below, in some implementations, the bottommost (furthest downhole) expandable disc element has the narrowest seat such that a small ball corresponding to the seat size of the bottommost expandable disc element can be dropped through the annulus without seating until it reaches the bottommost expandable disc element. As such, any number of the expandable disc elements 902, 904, 906, 908 of the pipe freeing tool 900 can be selectively and individually expanded. For example, as depicted in FIG. 9A, uppermost expandable disc element 902 has the widest seat 912, lowermost expandable disc element 908 has the narrowest seat 918, expandable disc element 914 has a seat 904 that is wider than the seats 916, 918 of disc elements 906 and 908, but narrower that seat 912, and disc element 916 has a seat that is wider than seat 918 of disc element 908, but narrower than seats 912, 914 of the expandable disc elements 902, 904.

An example operation of the pipe freeing tool 900 is described with reference to FIGS. 8A and 8B.

During drilling operations using a drillstring 910 coupled to the pipe freeing tool 900, an operator may determine that a section of drill pipe 936 along the drillstring 910 has become stuck against the surface of the wellbore 112, as depicted in FIG. 9A. In some implementations, a weight indicator (such as weight indicator 404 of FIGS. 4A-4D) or other downhole tool can be used to determine the depth of the stuck point within the wellbore 112. As can be seen in FIG. 9A, during normal drilling operations, each of the expandable disc elements 902, 904, 906, 908 is maintained in an unexpanded configuration 930.

In response to determining that a section of drill pipe 936 along the drillstring 910 has become stuck against the side of the wellbore 112, one or more of the expandable disc elements 902, 904, 906, 908 proximate the stuck point can be activated into an expanded configuration to free the stuck drill pipe 936 from the surface of the wellbore 112. For example, as depicted in FIG. 9B, expandable disc elements 906 and 908 proximate the stuck point of the stuck drill pipe 936 can be activated to expand outward from the drill pipe 936 into an expanded configuration 932.

As previously discussed, in some implementations, each of the expandable disc elements 902, 904, 906, 908 is expanded by seating a ball with a size corresponding to the width of the internal seat 912, 904, 906, 908 of the respective expandable disc element 902, 904, 906, 908 into the seat 912, 904, 906, 908 of the respective expandable disc element 902, 904, 906, 908. For example, as depicted in FIG. 9B, in order to active expandable disc elements 906 and 908, a first ball 920 with a diameter corresponding to the width of the internal seat 918 of expandable disc element 908 is dropped through the annulus of the drillstring 910 and seats within the internal seat 918 of expandable disc element 908. The diameter of the first ball 920 used to activate expandable disc element 908 is smaller than the width of the internal seats 912, 914, 916 of the other expandable disc elements 902, 904, 906, and, as a results, passes the through the annulus and seat 912, 914, 916 of each of the other expandable disc elements 902, 904, 906 without expanding the other expandable disc elements 904, 906, 908. By seating the first ball 920 within the seat 919 of expandable disc element 908 and then applying a pressure to the wellbore from the surface, the pressure within the expandable disc element 908 increases above a threshold pressure and causes the expandable disc element 908 to expand outward into an circular expanded configuration 932, as can be seen in FIG. 9B.

Still referring to FIG. 9B, a second expandable disc element located uphole of the activated expandable disc element 908 can also be activated into an expanded configuration, if necessary, to free the stuck drill pipe 936. For example, a second ball 922 with a diameter corresponding to the width of the internal seat 916 of expandable disc element 906 is dropped through the annulus of the drillstring 910 and seats within the internal seat 916 of expandable disc element 906. The diameter of the second ball 922 used to activate expandable disc element 906 is smaller than the width of the internal seats 912, 914 of the expandable disc elements 902, 904 uphole of expandable disc element 906. As a result, the second ball 922 passes the through the annulus and seat 912, 914 of each of the other uphole expandable disc elements 902, 904 without expanding the uphole expandable disc elements 902, 904. By seating the second ball 922 within expandable disc element 906 and then applying a pressure to the wellbore from the surface, the pressure within the expandable disc element 906 increases above a threshold pressure and causes the expandable disc element 906 to expand outward into a circular expanded configuration 932, as can be seen in FIG. 9B.

As can be seen in FIG. 9B, as the activated expandable disc elements 906, 908 each expand outwards, the surface of each of the expandable disc elements 906, 908 presses against the surface of the wellbore 112. As the activated expandable disc elements 906, 908 continue to expand outward and press against the surface of the wellbore 112, the activated expandable disc elements 906, 908 apply a side force the stuck drill pipe 936 and push the stuck drill pipe 936 towards the center of the wellbore 112. As a result, the stuck drill pipe 936 is freed from the surface of the wellbore 112, as depicted in FIG. 9B. As can be seen in FIG. 9B, in some implementations, the expandable disc elements 902, 904, 906, 908 are configured to expand to a diameter that corresponds to the diameter of the wellbore 112.

As depicted in FIG. 9C, in some implementations, once the section of stuck drill pipe 116 has been freed from the surface of the wellbore 112, the activated expandable disc elements 906, 908 are returned to the unexpanded configuration 930. For example, in some implementations, after freeing the stuck drill pipe 916 from the surface of the wellbore 112, the pressure within the wellbore 112 is increased to a threshold pressure that exceeds the pressure within the activated expandable disc element 906, 908, which causes the internal seats 912, 914, 916, 918 to rupture, which in turn causes the activated expandable disc elements 906, 908 of retract back into an unexpanded configuration 930. In some implementations, each of the expandable disc elements 902, 904, 906, 908 is activated and expands in response to application of approximately 1,000 psi of pressure. In some implementations, each of the expandable disc elements 902, 904, 906, 908 is deactivated and retracts into an unexpanded configuration 930 in response to application of pressure over approximately 1,500 psi. Retracting the activated expandable disc elements 906, 908 into an unexpanded configuration 930 after freeing the stuck drill pipe 916 from the surface of the wellbore 112 allows for drillstring 910 to be rotated within the wellbore 112 and drilling operations to continue within the wellbore 112.

While the pipe freeing tool 900 has been depicted as including four expandable disc elements 902, 904, 906, 908, other numbers of expandable disc elements can be included in the pipe freeing tool 900. In addition, while the expandable disc elements 902, 904, 906, 908 have been described as being activated into a circular expanded configuration 932, other shapes of expanded configurations, such as oval-shaped configurations, can be used. Further, while FIG. 9B depicts activating two of the expandable disc elements 902, 904, 906, 908 to free the stuck drill pipe 916, other numbers of the expandable disc elements may be selectively activated to free stuck drill pipe.

Figure 10:
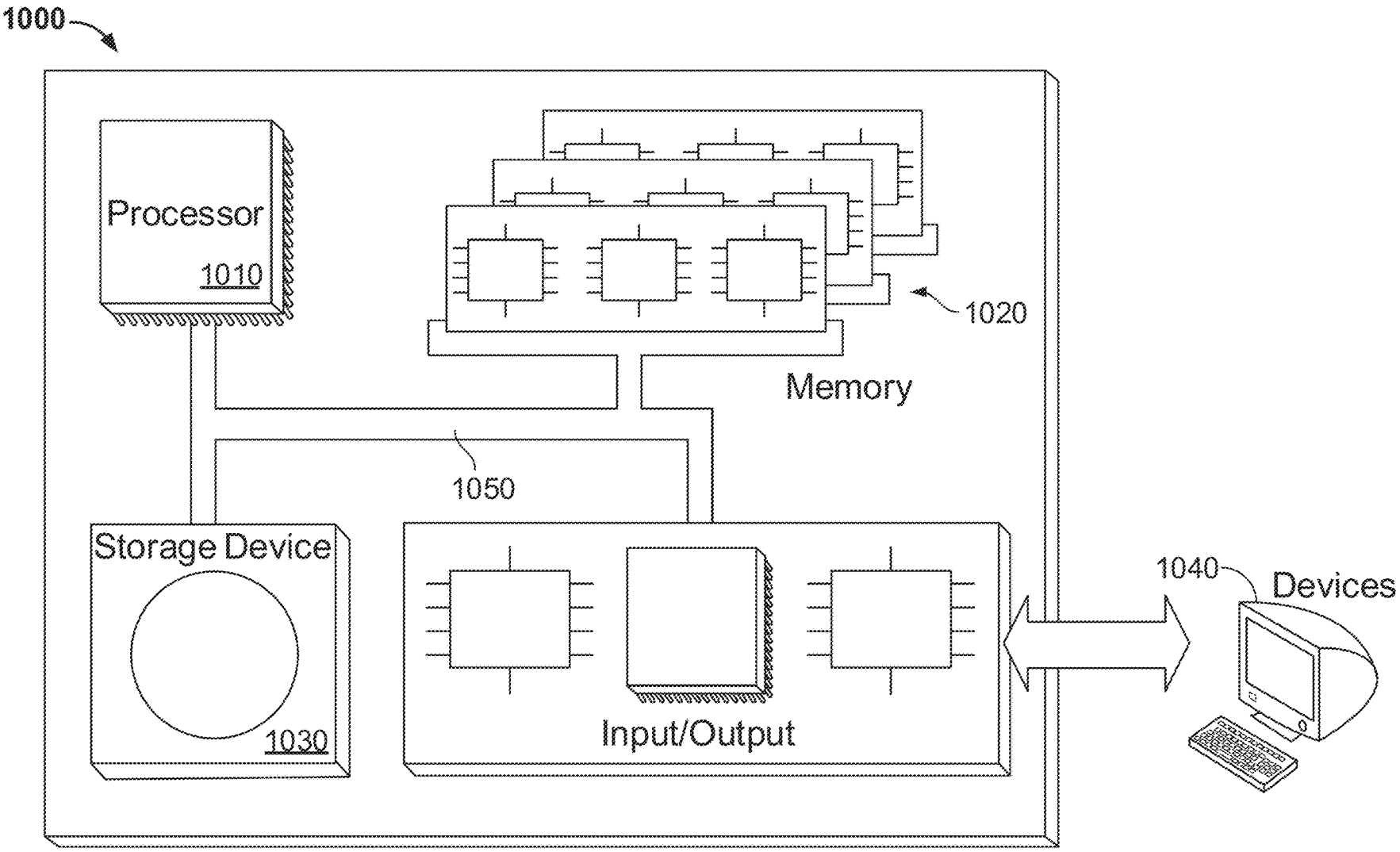
FIG. 10 is a schematic illustration of an example control system for a tool for freeing a stuck pipe from a wellbore according to the present disclosure.

FIG. 10 is a schematic illustration of an example controller 1000 (or control system 1000) for a downhole pipe freeing tool. For example, the controller 1000 can be used for the operations described previously, for example as or as part of the control system 124, or other controllers described herein. For example, the controller 1000 may be communicably coupled with, or as a part of, pipe freeing tool (such as pipe freeing tools 300, 500, 700, and 900) as described herein.

The controller 1000 is intended to include various forms of digital computers, such as printed circuit boards (PCB), processors, digital circuitry, or other hardware. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 1000 includes a processor 1010, a memory 1020, a storage device 1030, and an input/output device 1040. Each of the components 1010, 1020, 1030, and 1040 are interconnected using a system bus 1050. The processor 1010 is capable of processing instructions for execution within the controller 1000. The processor may be designed using any of a number of architectures. For example, the processor 1010 may be a CISC (Complex Instruction Set Computers) processor, a RISC (Reduced Instruction Set Computer) processor, or a MISC (Minimal Instruction Set Computer) processor.

In one implementation, the processor 1010 is a single-threaded processor. In another implementation, the processor 1010 is a multi-threaded processor. The processor 1010 is capable of processing instructions stored in the memory 1020 or on the storage device 1030 to display graphical information for a user interface on the input/output device 1040.

The memory 1020 stores information within the controller 1000. In one implementation, the memory 1020 is a computer-readable medium. In one implementation, the memory 1020 is a volatile memory unit. In another implementation, the memory 1020 is a non-volatile memory unit.

The storage device 1030 is capable of providing mass storage for the controller 1000. In one implementation, the storage device 1030 is a computer-readable medium. In various different implementations, the storage device 1030 may be a floppy disk device, a hard disk device, an optical disk device, or a tape device.

The input/output device 1040 provides input/output operations for the controller 1000. In one implementation, the input/output device 1040 includes a keyboard, a pointing device, or both. In another implementation, the input/output device 1040 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While certain embodiments have been described above, other embodiments are possible.

For example, while the pipe freeing tools 300, 500, 700, 900 have each been described as being used to free a stuck drill pipe along a drillstring, the tools 300, 500, 700, 900 can each be used to free stuck pipe along other types of strings, such as work strings.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method of freeing a stuck pipe in a wellbore, the method comprising:

positioning a pipe freeing tool within an annulus between the stuck pipe and the wellbore, the pipe freeing tool comprising:

a body; and two or more arms coupled to and extending from the body; and activating the two or more arms of the pipe freeing tool to extend outwards from the body to apply a force to the stuck pipe, wherein the force moves the stuck pipe away from a surface of the wellbore and towards a center of the wellbore, wherein the activating the two or more arms of the pipe freeing tool causes the two or more arms to perforate and extend through a wall of the stuck pipe, wherein the pipe freeing tool further comprises a plurality of cutting surfaces, wherein each cutting surface of the plurality of cutting surfaces is disposed on an end of a respective arm of the two or more arms and is configured to pierce the wall of the stuck pipe as the two or more arms are extended outwards from the body.

2. The method of claim 1, wherein an outer diameter of the body is smaller than an inner diameter of the stuck pipe.

3. The method of claim 1, wherein positioning the pipe freeing tool within the annulus of the stuck pipe comprises:

coupling the pipe freeing tool to a downhole conveyance; and lowering the pipe freeing tool through an annulus of the stuck pipe using the downhole conveyance.

4. The method of claim 3 wherein the downhole conveyance comprises at least one of a pipe, a wireline, a working string, or coiled tubing.

5. The method of claim 1, wherein activating the two or more arms of the pipe freeing tool comprises activating the two or more arms using a power cable coupled to the pipe freeing tool.

6. The method of claim 1, wherein activating the two or more arms causes the two or arms to extend outwards from the body until each of the two or more arms contacts the surface of the wellbore.

7. The method of claim 1, wherein activating the two or more arms causes the two or arms to extend outwards from the body until each of the two or more arms extends to a predetermined extended length.

8. The method of claim 7, wherein the predetermined extended length corresponds to a size of the wellbore.

* * * * *